US010596717B2

(12) United States Patent
Hashish et al.

(10) Patent No.: US 10,596,717 B2
(45) Date of Patent: Mar. 24, 2020

(54) METHODS OF CUTTING FIBER REINFORCED POLYMER COMPOSITE WORKPIECES WITH A PURE WATERJET

(71) Applicant: Flow International Corporation, Kent, WA (US)

(72) Inventors: Mohamed A. Hashish, Bellevue, WA (US); Charles D. Burnham, Southbury, CT (US); Steven J. Craigen, Auburn, WA (US)

(73) Assignee: Flow International Corporation, Kent, WA (US)

( * ) Notice: Subject to any disclaimer, the term of this patent is extended or adjusted under 35 U.S.C. 154(b) by 51 days.

(21) Appl. No.: 14/798,222

(22) Filed: Jul. 13, 2015

(65) Prior Publication Data

US 2017/0015018 A1 Jan. 19, 2017

(51) Int. Cl.

| | |
|---|---|
| ***B26F 3/00*** | (2006.01) |
| ***B26D 5/06*** | (2006.01) |
| ***B26F 1/38*** | (2006.01) |
| ***B26D 7/08*** | (2006.01) |

(52) U.S. Cl.

CPC ..... *B26F 3/004* (2013.01); *B26D 5/06* (2013.01); *B26D 7/08* (2013.01); *B26F 1/3806* (2013.01); *B26F 1/3813* (2013.01)

(58) Field of Classification Search

CPC ..... B26F 3/004; B26F 1/3813; B26F 1/3806; B26D 5/06; B26D 7/08; Y10T 83/443; Y10T 83/0453

See application file for complete search history.

(56) References Cited

U.S. PATENT DOCUMENTS

| | | | |
|---|---|---|---|
| 2,658,312 | A | 11/1953 | Smith |
| 2,985,050 | A | 5/1961 | Schwacha |
| 3,531,214 | A | 9/1970 | Abramson |
| 3,589,351 | A | 6/1971 | Shoupp et al. |
| 3,678,689 | A | 7/1972 | Ishiwata |
| 3,733,676 | A | 5/1973 | Morgan |
| 3,851,421 | A | 12/1974 | Stroszynski |

(Continued)

FOREIGN PATENT DOCUMENTS

| | | | |
|---|---|---|---|
| CN | 2229553 | Y | 6/1996 |
| CN | 2246028 | Y | 1/1997 |

(Continued)

OTHER PUBLICATIONS

E. Uhlmann, et al., "Machining of Carbon Fibre Reinforced Plastics," New Production Technologies in Aerospace Industry—5th Machining Innovations Conference (MIC 2014), 2014, available on May 11, 2018, at : https://ac.els-cdn.com/S2212827114009482/1-s2.0-S2212827114009482-main.pdf?_tid=c5e28bff-9290-4f9a-840a-bcf011adca87&acdnat=1526049457_42ba9a1298.*

(Continued)

*Primary Examiner* — Jonathan G Riley
(74) *Attorney, Agent, or Firm* — Cozen O'Connor

(57) ABSTRACT

Methods of trimming fiber reinforced polymer composite workpieces are provided which use a pure waterjet discharged from a cutting head in liquid phase unladened with solid particles at an operating pressure of at least 60,000 psi and in combination with other cutting parameters to provide a final component profile without delamination, splintering, fraying or unacceptable fiber pullout or fiber fracture.

24 Claims, 17 Drawing Sheets

(56) References Cited

U.S. PATENT DOCUMENTS 3,877,334 A 4/1975 Gerber
3,894,180 A 7/1975 Canino
3,996,825 A 12/1976 Terry
4,412,402 A 11/1983 Gallant
4,435,902 A 3/1984 Mercer et al.
4,478,368 A 10/1984 Yie
4,541,423 A 9/1985 Barber
4,555,872 A 12/1985 Yie
4,563,688 A 1/1986 Braun
4,723,387 A 2/1988 Krasnoff
4,765,540 A 8/1988 Yie
4,802,156 A 1/1989 Shyu et al.
4,814,574 A 3/1989 Babel et al.
4,843,287 A 6/1989 Taft
4,849,769 A 7/1989 Dressler
4,878,676 A 11/1989 Johnson
4,934,111 A 6/1990 Hashish et al.
4,942,284 A 7/1990 Etcheparre et al.
4,975,557 A 12/1990 Yamada et al.
5,021,941 A 6/1991 Ford et al.
5,065,789 A 11/1991 Eslinger
5,154,347 A 10/1992 Vijay
5,168,671 A 12/1992 Kataoka et al.
5,207,533 A * 5/1993 Federspiel ..... E21B 7/30 405/156
5,361,286 A 11/1994 Monserud et al.
5,387,969 A 2/1995 Marantette
5,418,824 A 5/1995 Monserud et al.
5,429,460 A 7/1995 Campian
5,599,223 A 2/1997 Mains
5,642,766 A 7/1997 MacCauley
5,643,058 A 7/1997 Erichsen et al.
5,794,858 A 8/1998 Munoz
5,877,960 A 3/1999 Gross et al.
5,887,122 A 3/1999 Terawaki et al.
5,901,595 A 5/1999 Massee
5,903,459 A 5/1999 Greenwood et al.
6,001,219 A 12/1999 Caspar
6,062,778 A 5/2000 Szuba et al.
6,103,049 A 8/2000 Batdorf
6,125,729 A 10/2000 Mirabello
6,155,245 A 12/2000 Zanzuri
6,172,374 B1 1/2001 Banks et al.
6,204,475 B1 3/2001 Nakata et al.
6,220,529 B1 4/2001 Xu
6,280,302 B1 * 8/2001 Hashish ..... B24C 5/04 451/102
6,315,215 B1 11/2001 Gipson et al.
6,354,285 B1 3/2002 Licht et al.
6,379,214 B1 4/2002 Stewart et al.
6,464,567 B2 10/2002 Hashish et al.
6,492,617 B2 12/2002 Nagahori et al.
6,540,586 B2 4/2003 Sciulli
6,649,123 B2 11/2003 Babai
6,752,686 B1 6/2004 Hashish et al.
6,755,725 B2 6/2004 Hashish et al.
6,766,216 B2 7/2004 Erichsen et al.
6,852,002 B2 2/2005 Stewart et al.
6,875,084 B2 4/2005 Hashish et al.
7,008,481 B2 3/2006 Giolando et al.
7,331,842 B2 * 2/2008 Sciulli ..... B23Q 17/2233 324/207.2
7,402,096 B2 7/2008 Lisec
7,464,630 B2 12/2008 Knaupp et al.
7,578,210 B2 8/2009 Sciulli et al.
7,591,615 B2 9/2009 Li et al.
7,594,614 B2 9/2009 Vijay et al.
7,615,128 B2 11/2009 Mikkelsen
7,635,289 B2 12/2009 Sciulli et al.
7,703,363 B2 4/2010 Knaupp et al.
7,803,036 B2 9/2010 Sciulli et al.
8,047,798 B2 11/2011 Bech
8,131,385 B2 3/2012 Yuzawa
8,210,908 B2 7/2012 Hashish
8,322,700 B2 12/2012 Saberton et al.
8,448,880 B2 5/2013 Hashish et al.
8,527,084 B2 9/2013 Maurer
8,534,169 B2 9/2013 Morita et al.
8,550,873 B2 10/2013 Vijay et al.
8,894,903 B2 11/2014 Bakker et al.
9,764,979 B2 9/2017 Fujii et al.
2001/0018855 A1 9/2001 Sciulli
2002/0036895 A1 3/2002 Odashima et al.
2003/0037650 A1 2/2003 Knaupp et al.
2003/0046801 A1 3/2003 Engström et al.
2004/0107810 A1 6/2004 Sciulli et al.
2004/0235395 A1 11/2004 Hashish et al.
2004/0259478 A1 12/2004 Hashish et al.
2005/0017091 A1 1/2005 Olsen et al.
2005/0050706 A1 3/2005 Motzno
2005/0051602 A1 3/2005 Babb et al.
2006/0204384 A1 9/2006 Cornell et al.
2008/0006301 A1 1/2008 Garry et al.
2008/0057839 A1 3/2008 Anderson et al.
2008/0142050 A1 * 6/2008 Hashish ..... B24C 3/325 134/22.12
2008/0216625 A1 9/2008 Li et al.
2009/0071303 A1 3/2009 Hashish et al.
2009/0140482 A1 6/2009 Saberton et al.
2009/0183790 A1 7/2009 Moore
2009/0204272 A1 8/2009 Yuzawa
2009/0255602 A1 10/2009 McMasters et al.
2009/0288532 A1 11/2009 Hashish
2009/0305611 A1 12/2009 Anton et al.
2009/0320661 A1 * 12/2009 Swift ..... B24C 3/02 83/53
2010/0072261 A1 3/2010 Cruz et al.
2010/0089956 A1 4/2010 Blake
2010/0173570 A1 7/2010 Reukers
2010/0224543 A1 9/2010 Ellis et al.
2010/0294024 A1 11/2010 Kumar et al.
2011/0079339 A1 4/2011 Cruz et al.
2011/0087363 A1 4/2011 Petrescu et al.
2011/0089956 A1 4/2011 Hermann et al.
2011/0113940 A1 5/2011 Florean
2012/0021676 A1 1/2012 Schubert et al.
2012/0085211 A1 4/2012 Liu et al.
2012/0111115 A1 5/2012 Lime et al.
2012/0111186 A1 5/2012 Kohlbrenner et al.
2012/0247296 A1 10/2012 Stang et al.
2012/0297943 A1 * 11/2012 Grosbois ..... B26D 7/10 83/15
2012/0315824 A1 12/2012 Jarchau et al.
2012/0322347 A1 12/2012 Molz et al.
2013/0025422 A1 * 1/2013 Chillman ..... B24C 1/045 83/53
2013/0112056 A1 5/2013 Chacko et al.
2013/0213200 A1 8/2013 Cooper
2014/0094093 A1 * 4/2014 Miller ..... B24C 7/0023 451/39
2014/0116217 A1 5/2014 Hashish et al.
2014/0165807 A1 6/2014 David et al.
2015/0196989 A1 7/2015 Hashish et al.
2015/0251331 A1 * 9/2015 Vandergon ..... F04B 49/10 83/177
2015/0321315 A1 11/2015 Chalmers et al.
2016/0039069 A1 2/2016 Schubert et al.
2016/0287374 A1 * 10/2016 Soletti ..... A61L 27/34
2017/0015018 A1 1/2017 Hashish et al.
2017/0106606 A1 * 4/2017 Toyozumi ..... B23C 3/00
2017/0151651 A1 * 6/2017 Miller ..... B24C 7/0023
2018/0099378 A1 4/2018 Hashish et al.

FOREIGN PATENT DOCUMENTS

CN 2406979 Y 11/2000
CN 2850822 Y 12/2006
CN 2895428 Y 5/2007
CN 201177121 Y 1/2009
CN 202213012 U 5/2012
CN 202388567 U 8/2012
CN 103272799 A 9/2013
DE 4005453 A1 8/1991

(56) References Cited

FOREIGN PATENT DOCUMENTS

| | | | |
|---|---|---|---|
| DE | 4120613 | A1 | 3/1992 |
| DE | 29920344 | U1 | 3/2000 |
| DE | 19849814 | A1 | 5/2000 |
| DE | 10051942 | A1 | 5/2002 |
| DE | 10056329 | A1 | 7/2002 |
| DE | 10308330 | A1 | 9/2004 |
| EP | 1820604 | A1 | 8/2007 |
| EP | 2230397 | A1 | 9/2010 |
| EP | 2 736 678 | | 6/2014 |
| FR | 2480171 | A1 | 10/1981 |
| FR | 2754331 | A1 | 4/1998 |
| JP | 1159173 | A | 6/1989 |
| JP | 0623670 | A | 2/1994 |
| JP | 2000034721 | A | 2/2000 |
| JP | 2008098216 | A | 4/2008 |
| JP | 2010105113 | A | 5/2010 |
| JP | 2011-11314 | A | 1/2011 |
| KR | 10-2001-0025910 | A | 4/2001 |
| KR | 10-0873900 | B1 | 12/2008 |
| KR | 10-2012-0031027 | A | 3/2012 |
| TW | 564201 | B | 12/2003 |
| WO | 2014/111213 | A2 | 7/2014 |
| WO | 2015/065886 | A2 | 5/2015 |
| WO | 2015/108692 | A1 | 7/2015 |

OTHER PUBLICATIONS

Shanmugam et al., "A study of delamination on graphite/epoxy composites in abrasive waterjet machining," Composites Part A: Applied Science and Manufacturing, Elsevier Science Publishers B.V., Amsterdam, NL, vol. 39, No. 6, Jun. 1, 2008, pp. 923-929.

Guo et al., "Cutting Quality Prediction of a Quasi-5-Axis Abrasive Waterjet Machine with an Adjustable Workhead," Networking, Sensing and Control (ICNSC), 2012 9$^{th}$ IEEE International Conference, Apr. 11, 2012, pp. 181-186.

Luo, "Cutting Composite with High Pressure Water Jets," 5$^{th}$ *Pacific Rim International Conference on Water Jet Technology*, Feb. 3-5, 1998, New Delhi, India, 11 pages.

Ying, Wei, "A Continuous Water Jet Booster with 6000 Bar High Pressure and its Industrial Test", Quarterly of CIMR, vol. 6 No. 4, Dec. 1986, 135-140 (with English Abstract).

Optex Fa Co., Ltd., Displacement Sensor CD33 Series Instruction Manual, available as early as Jun. 2011, 2 pages.

* cited by examiner

METHODS OF CUTTING FIBER REINFORCED POLYMER COMPOSITE WORKPIECES WITH A PURE WATERJET

BACKGROUND

Technical Field

This disclosure is related to high-pressure waterjet cutting systems and related methods, and, more particularly, to methods of cutting fiber reinforced polymer composite workpieces with a pure waterjet.

Description of the Related Art

Waterjet or abrasive waterjet cutting systems are used for cutting a wide variety of materials, including stone, glass, ceramics and metals. In a typical waterjet cutting system, high-pressure water flows through a cutting head having a nozzle which directs a cutting jet onto a workpiece. The system may draw or feed abrasive media into the high-pressure waterjet to form a high-pressure abrasive waterjet. The cutting head may then be controllably moved across the workpiece to cut the workpiece as desired, or the workpiece may be controllably moved beneath the waterjet or abrasive waterjet. Systems for generating high-pressure waterjets are currently available, such as, for example, the Mach 4™ five-axis waterjet cutting system manufactured by Flow International Corporation, the assignee of the present application. Other examples of waterjet cutting systems are shown and described in Flow's U.S. Pat. No. 5,643,058.

Abrasive waterjet cutting systems are advantageously used when cutting workpieces made of particularly hard materials, such as, for example, high-strength steel and fiber reinforced polymer composites to meet exacting standards; however, the use of abrasives introduces complexities and abrasive waterjet cutting systems can suffer from other drawbacks, including the need to contain and manage spent abrasives.

Other known options for cutting fiber reinforced polymer composites include machining (e.g., drilling, routing) such materials with carbide and diamond coated carbide cutting tools (e.g., drill bits, routers). Machining forces from such cutting tools, however, can promote workpiece failures such as delamination, fraying, splintering, fiber pullout, fiber fracture and/or matrix smearing. These types of cutting tools can also be susceptible to premature wear and must be replaced frequently when cutting fiber reinforced polymer composite workpieces to ensure an acceptable finish, thereby increasing operational costs. Moreover, machining fiber reinforced polymer composite parts with carbide cutting tools generates dust that can create environmental hazards and negatively impact machining performance.

BRIEF SUMMARY

Embodiments described herein provide methods of cutting fiber reinforced polymer composite workpieces with high-pressure pure waterjets in liquid form unladened with solid particles, which are particularly well adapted for trimming thin shelled fiber reinforced polymer composite parts to include a final component profile to meet generally accepted industry quality standards, such as quality standards of the automotive industry.

Embodiments include methods of trimming fiber reinforced polymer composite workpieces with a pure waterjet discharged from a cutting head in liquid phase unladened with solid particles at or above a threshold operating pressure of at least 60,000 psi and in combination with other cutting parameters to provide a final component profile without delamination, splintering, fraying or unacceptable fiber pullout or fiber fracture. Advantageously, the use of abrasive media, such as garnet, may be avoided, which can simplify the cutting process and provide a cleaner work environment. In addition, fixturing may be simplified when trimming or otherwise cutting with a pure waterjet as the pure waterjet is less destructive to support structures underlying the workpieces.

In one embodiment, a method of trimming a fiber reinforced polymer composite workpiece may be summarized as including: providing the fiber reinforced polymer composite workpiece in an unfinished state in which fiber reinforced polymer composite material of the workpiece extends beyond a final component profile thereof; generating a pure waterjet via a cutting head in liquid phase unladened with solid particles at an operating pressure of at least 60,000 psi; directing the pure waterjet to pass through the fiber reinforced polymer composite workpiece; and moving one of the cutting head and the fiber reinforced polymer composite workpiece relative to the other along a predetermined path while maintaining the operating pressure of at least 60,000 psi such that the pure waterjet trims the fiber reinforced polymer composite material to the final component profile without delamination, splintering, fraying or unacceptable fiber pullout or fiber fracture.

Moving the cutting head and the fiber reinforced polymer composite workpiece relative to each other along the predetermined path may include moving at a cutting speed based at least in part on a thickness of the fiber reinforced polymer composite workpiece and a magnitude of the operating pressure. The cutting speed may also be based at least in part on a type of fiber, a type of matrix material, and/or a type of fabrication scheme of the fiber reinforced polymer composite workpiece. The fiber reinforced polymer composite workpiece may include carbon fibers, glass fibers, boron fibers or polyamide fibers, and the fiber reinforced polymer composite workpiece may be built up from layers of fibers, tape or cloth impregnated with the matrix material. The cutting speed may also be based at least in part on an orifice size of an orifice member used to generate the pure waterjet.

The method of trimming the fiber reinforced polymer composite workpiece may further include: piercing the fiber reinforced polymer composite workpiece at an area within the final component profile at any operating pressure (including below 60,000 psi) and creating an aperture surrounded by a localized area of delamination; and moving one of the cutting head and the fiber reinforced polymer composite workpiece relative to the other along another predetermined path while maintaining operating pressure of at least 60,000 psi such that the pure waterjet cuts an internal feature within the fiber reinforced polymer composite material and removes the localized area of delamination.

The method of trimming the fiber reinforced polymer composite workpiece may further include, while moving the cutting head and the fiber reinforced polymer composite workpiece relative to each other along at least a portion of the predetermined path, simultaneously directing a gas stream onto an exposed surface of the fiber reinforced polymer composite workpiece at or adjacent a cutting location of the pure waterjet to maintain a cutting environment at the cutting location which is, apart from the pure waterjet, substantially devoid of fluid or particulate matter.

The method of trimming the fiber reinforced polymer composite workpiece may further include: maintaining a terminal end of the cutting head away from the fiber reinforced polymer composite workpiece at a distance that exceeds a threshold distance while directing the pure waterjet to pass through and pierce the fiber reinforced polymer composite workpiece, and subsequently, moving and maintaining the terminal end of the cutting head relatively closer to the fiber reinforced polymer composite workpiece while trimming the fiber reinforced polymer composite material to the final component profile.

The method of trimming the fiber reinforced polymer composite workpiece may further include introducing a gas stream into a path of the pure waterjet to alter a coherence of the pure waterjet during at least a portion of the trimming method.

Moving one of the cutting head and the fiber reinforced polymer composite workpiece relative to the other along the predetermined path may include moving the cutting head with a multi-axis manipulator while the fiber reinforced polymer composite workpiece remains stationary. In other instances, moving one of the cutting head and the fiber reinforced polymer composite workpiece relative to the other along the predetermined path may include moving the fiber reinforced polymer composite workpiece with a multi-axis manipulator while the cutting head remains stationary.

The method of trimming the fiber reinforced polymer composite workpiece may further include maintaining a linear power density of the pure waterjet above a threshold linear power density sufficient to cut the fiber reinforced polymer composite workpiece along the final component profile without delamination, splintering, fraying or unacceptable fiber pullout or fiber fracture.

The method of trimming the fiber reinforced polymer composite workpiece may further include controlling a cutting speed based on a plurality of operating parameters including material thickness, material type, operating pressure and orifice size. The plurality of operating parameters may further include a tolerance level.

A method of trimming a fiber reinforced polymer composite workpiece may also be provided which comprises controlling a cutting speed based on a plurality of operating parameters to maintain backside linear defects consisting of small localized areas of delamination below a threshold acceptable defect level.

DETAILED DESCRIPTION

Figure 1:
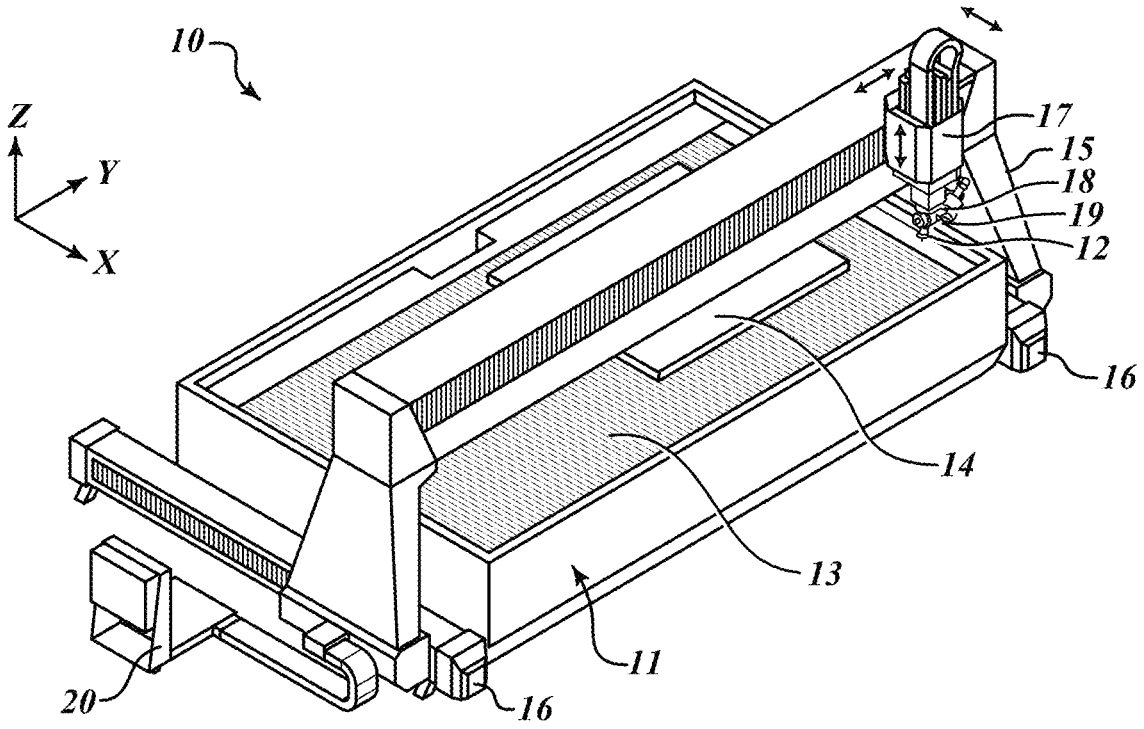
FIG. 1 is a view of an example high-pressure waterjet cutting system, according to one embodiment, which comprises a multi-axis manipulator (e.g., gantry motion system) supporting a cutting head assembly at a working end thereof for trimming fiber reinforced polymer composite workpieces.
Figure 2:
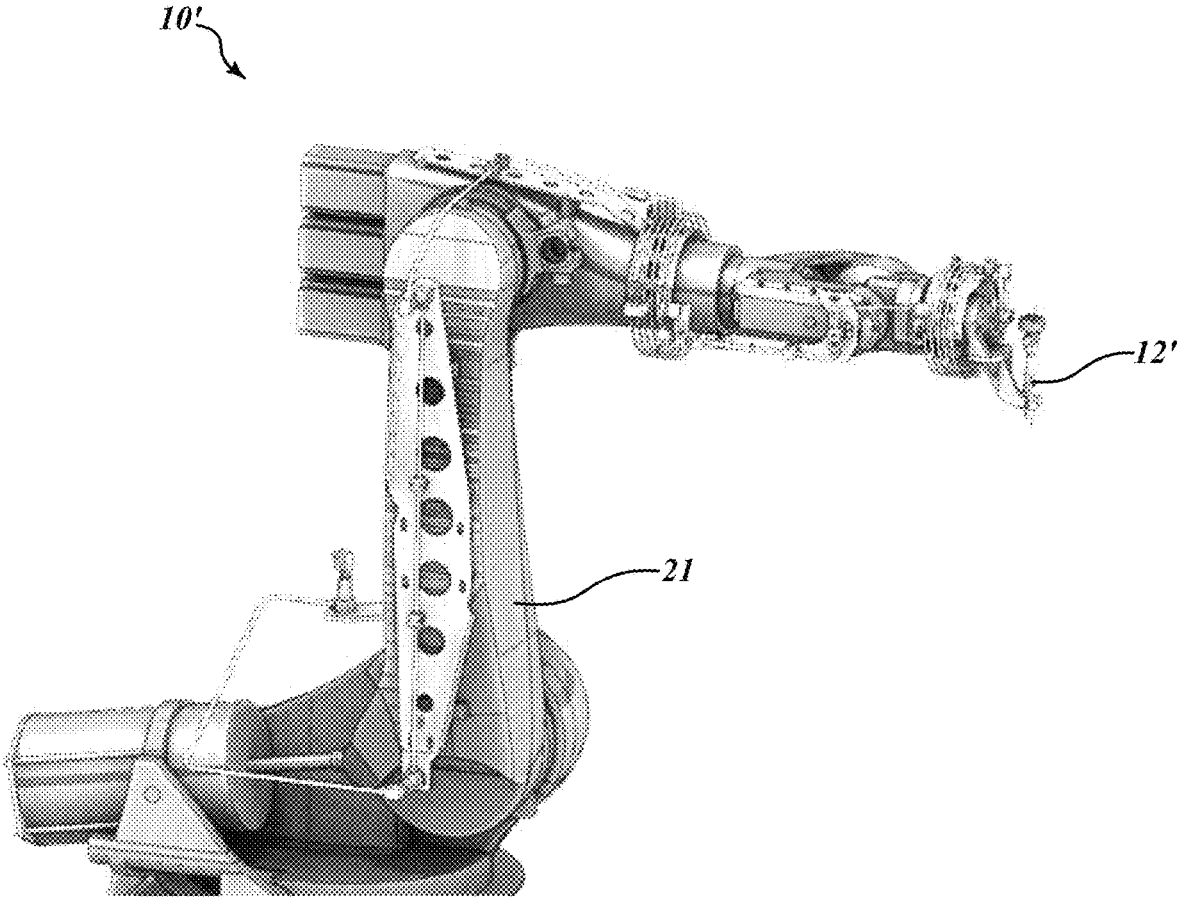
FIG. 2 is a view of an example high-pressure waterjet cutting system, according to another embodiment, which comprises a multi-axis manipulator (e.g., multi-axis robotic arm) supporting a cutting head assembly at a working end thereof for trimming fiber reinforced polymer composite workpieces.
Figure 3:
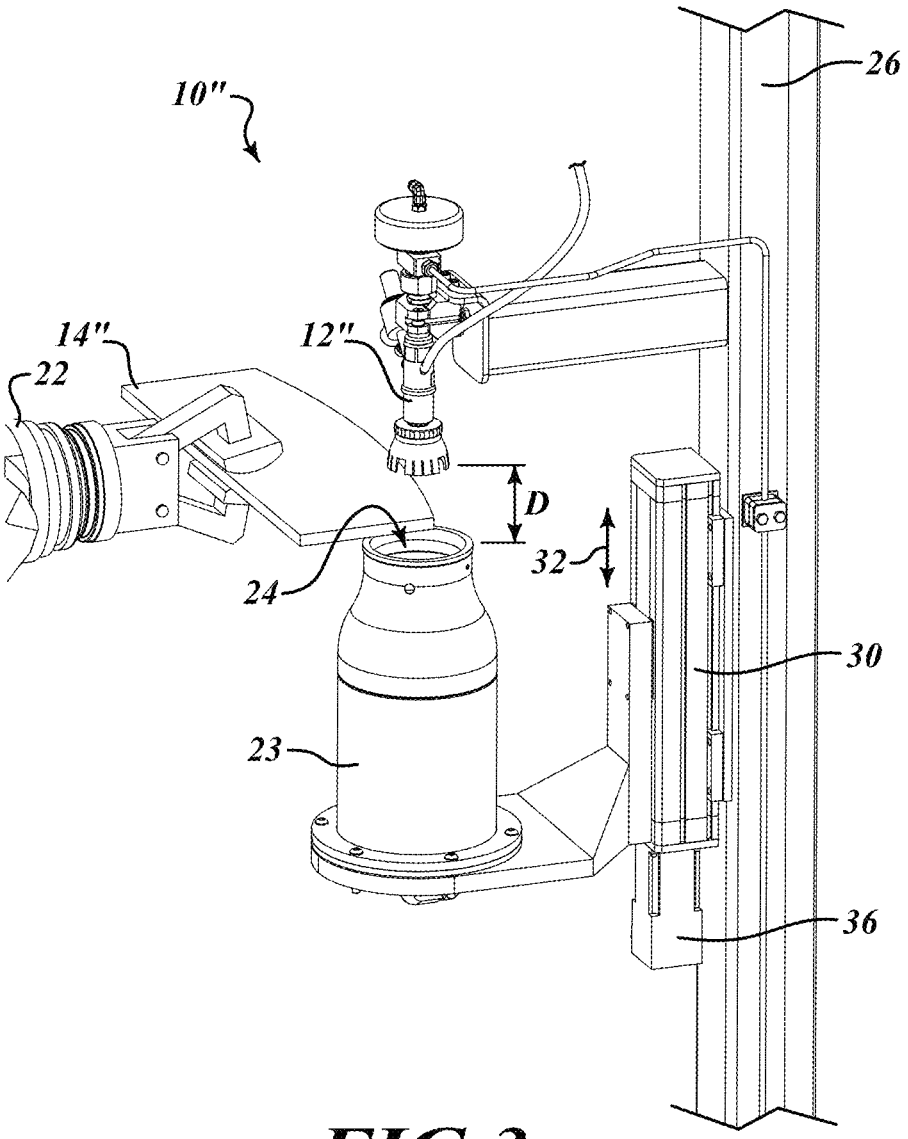
FIG. 3 is a view of an example high-pressure waterjet cutting system, according to yet another embodiment, which comprises a multi-axis manipulator (e.g., multi-axis robotic arm) for manipulating fiber reinforced polymer composite workpieces beneath a cutting head assembly for trimming purposes.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet cutting systems and methods of operating the same may not be shown or described in detail to avoid unnecessarily obscuring descriptions of the embodiments. For instance, well known control systems and drive components may be integrated into the waterjet cutting systems to facilitate movement of the waterjet cutting head assembly relative to the workpiece or work surface to be processed. These systems may include drive components to manipulate the cutting head about multiple rotational and translational axes, as is common in multi-axis manipulators of waterjet cutting systems. Example waterjet cutting systems may include a waterjet cutting head assembly coupled to a gantry-type motion system, as shown in FIG. 1, a robotic arm motion system, as shown in FIG. 2, or other motion system for moving the cutting head relative to a workpiece. In other instances, a robotic arm motion system or other motion system may manipulate the workpiece relative to a cutting head, as shown in FIG. 3.

Unless the context requires otherwise, throughout the specification and claims which follow, the word "comprise" and variations thereof, such as "comprises" and "comprising," are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide methods of trimming fiber reinforced polymer composite workpieces with a pure waterjet discharged from a cutting head in liquid phase unladened with solid particles at or above a threshold operating pressure of at least 60,000 psi and in combination with other cutting parameters to provide a final component profile without delamination, splintering, fraying or unacceptable fiber pullout or fiber fracture.

As used herein, the term cutting head or cutting head assembly may refer generally to an assembly of components at a working end of the waterjet machine or system, and may include, for example, an orifice member, such as a jewel orifice, through which fluid passes during operation to generate a high-pressure waterjet, a nozzle component (e.g., nozzle nut) for discharging the high-pressure waterjet and surrounding structures and devices coupled directly or indirectly thereto to move in unison therewith. The cutting head may also be referred to as an end effector or nozzle assembly.

The waterjet cutting system may operate in the vicinity of a support structure which is configured to support a workpiece to be processed by the system. The support structure may be a rigid structure or a reconfigurable structure suitable for supporting one or more workpieces (e.g., fiber reinforced polymer composite automotive parts) in a position to be cut, trimmed or otherwise processed.

FIG. 1 shows an example embodiment of a waterjet cutting system 10. The waterjet cutting system 10 includes a catcher tank assembly 11 having a work support surface 13 (e.g., an arrangement of slats) that is configured to support a workpiece 14 to be processed by the system 10. The waterjet cutting system 10 further includes a bridge assembly 15 which is movable along a pair of base rails 16 and straddles the catcher tank assembly 11. In operation, the bridge assembly 15 can move back and forth along the base rails 16 with respect to a translational axis X to position a cutting head assembly 12 of the system 10 for processing the workpiece 14. A tool carriage 17 may be movably coupled to the bridge assembly 15 to translate back and forth along another translational axis Y, which is aligned perpendicularly to the aforementioned translational axis X. The tool carriage 17 may be configured to raise and lower the cutting head assembly 12 along yet another translational axis Z to move the cutting head assembly 12 toward and away from the workpiece 14. One or more manipulable links or members may also be provided intermediate the cutting head assembly 12 and the tool carriage 17 to provide additional functionality.

As an example, the waterjet cutting system 10 may include a forearm 18 rotatably coupled to the tool carriage 17 for rotating the cutting head assembly 12 about an axis of rotation, and a wrist 19 rotatably coupled to the forearm 18 to rotate the cutting head assembly 12 about another axis of rotation that is non-parallel to the aforementioned rotational axis. In combination, the rotational axes of the forearm 18 and wrist 19 can enable the cutting head assembly 12 to be manipulated in a wide range of orientations relative to the workpiece 14 to facilitate, for example, cutting of complex profiles. The rotational axes may converge at a focal point which, in some embodiments, may be offset from the end or tip of a nozzle component (e.g., nozzle component 120 of FIGS. 8 through 10) of the cutting head assembly 12. The end or tip of the nozzle component of the cutting head assembly 12 is preferably positioned at a desired standoff distance from the workpiece 14 or work surface to be processed. The standoff distance may be selected or maintained at a desired distance to optimize the cutting performance of the waterjet. For example, in some embodiments, the standoff distance may be maintained at about 0.20 inch (5.1 mm) or less, or in some embodiments at about 0.10 inch (2.5 mm) or less. In other embodiments, the standoff distance may vary over the course of a trimming operation or during a cutting procedure, such as, for example, when piercing the workpiece. In some instances, the nozzle component of the waterjet cutting head may be particularly slim or slender to enable, among other things, inclining of the nozzle component relative to the workpiece with minimal stand-off distance (e.g., a 30 degree inclination with standoff distance less than or equal to about 0.5 inch (12.7 mm)).

During operation, movement of the cutting head assembly 12 with respect to each of the translational axes and one or more rotational axes may be accomplished by various conventional drive components and an appropriate control system 20 (FIG. 1). The control system may generally include, without limitation, one or more computing devices, such as processors, microprocessors, digital signal processors (DSP), application-specific integrated circuits (ASIC), and the like. To store information, the control system may also include one or more storage devices, such as volatile memory, non-volatile memory, read-only memory (ROM), random access memory (RAM), and the like. The storage devices can be coupled to the computing devices by one or more buses. The control system may further include one or more input devices (e.g., displays, keyboards, touchpads, controller modules, or any other peripheral devices for user input) and output devices (e.g., display screens, light indicators, and the like). The control system can store one or more programs for processing any number of different workpieces according to various cutting head movement instructions. The control system may also control operation of other components, such as, for example, a secondary fluid source, a vacuum device and/or a pressurized gas source coupled to the pure waterjet cutting head assemblies and components described herein. The control system, according to one embodiment, may be provided in the form of a general purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to, among other things, routing high-pressure water through the waterjet cutting systems described herein, providing a flow of secondary fluid to adjust or modify the coherence of a discharged fluid jet and/or providing a pressurized gas stream to provide for unobstructed pure waterjet cutting of a fiber reinforced polymer composite workpiece.

Further example control methods and systems for waterjet cutting systems, which include, for example, CNC functionality, and which are applicable to the waterjet cutting systems described herein, are described in Flow's U.S. Pat. No. 6,766,216, which is incorporated herein by reference in its entirety. In general, computer-aided manufacturing (CAM) processes may be used to efficiently drive or control a waterjet cutting head along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a waterjet cutting system to manipulate the cutting head about various translational and/or rotational axes to cut or process a workpiece as reflected in the CAD model. Details of the control system, conventional drive components and other well-known systems associated with waterjet cutting systems, however, are not shown or described in detail to avoid unnecessarily obscuring descriptions of the embodiments. Other known systems associated with waterjet cutting systems include, for example, a high-pressure fluid source (e.g., direct drive and intensifier pumps with pressure ratings ranging from about 60,000 psi to 110,000 psi and higher) for supplying high-pressure fluid to the cutting head.

According to some embodiments, the waterjet cutting system 10 includes a pump, such as, for example, a direct drive pump or intensifier pump (not shown), to selectively provide a source of high-pressure water at an operating pressure of at least 60,000 psi or between about 60,000 psi and about 110,000 psi or higher. The cutting head assembly 12 of the waterjet cutting system 10 is configured to receive the high-pressure water supplied by the pump and to generate a high-pressure pure waterjet for processing workpieces, including, in particular, fiber reinforced polymer composite workpieces. A fluid distribution system (not shown) in fluid communication with the pump and the cutting head assembly 12 is provided to assist in routing high-pressure water from the pump to the cutting head assembly 12.

FIG. 2 shows another example embodiment of a waterjet cutting system 10'. According to this example embodiment, the waterjet cutting system 10' includes a cutting head assembly 12' that is supported at the end of a multi-axis manipulator in the form of a multi-axis robotic arm 21. In this manner, the multi-axis robotic arm 21 can manipulate the cutting head assembly 12' in space to process workpieces supported by a separate workpiece support structure or fixture (not shown).

FIG. 3 shows yet another embodiment of a waterjet cutting system 10". According to this example embodiment, the waterjet cutting system 10" includes a cutting head assembly 12" that is supported opposite a jet receiving receptacle 23 via a rigid support structure 26. As shown in FIG. 3, the jet receiving receptacle 23 may be coupled to the support structure 26 or other foundational structure in a manner that enables a clearance gap distance D between the cutting head assembly 12" and an inlet aperture 24 of the jet receiving receptacle 23 to be adjusted. For example, in some embodiments, a linear positioner 30 may be provided intermediately between the support structure 26 and the jet receiving receptacle 23 to enable the jet receiving receptacle 23 to be controllably moved toward and away from the cutting head assembly 12", as represented by the arrows labeled 32. Example linear positioners 30 include HD Series linear positioners available from the Electromechanical Automation Division of Parker Hannifin Corporation located in Irwin, Pa. The linear positioner 30 may be coupled to the support structure 26 with clamps or other fastening devices and the jet receiving receptacle 23 may be coupled to the linear positioner 30 by a support arm or other structural member.

The linear positioner 30 may include a motor 36 in communication with a control system to enable controlled movement of the linear positioner 30 and adjustment of the clearance gap distance D before, during and/or after workpiece processing operations. In this manner, the inlet aperture 24 of the jet receiving receptacle 23 can be maintained in close proximity to a discharge side of a workpiece 14" to be processed. The clearance gap distance D may be adjusted to accommodate workpieces 14" of different thicknesses or of varying thicknesses. In some embodiments, the clearance gap distance D may be adjusted during processing of a workpiece 14" (or a portion thereof) to reduce or minimize a gap between a rear discharge surface of the workpiece 14" and the inlet aperture 24 of the jet receiving receptacle 23 while a multi-axis manipulator in the form of a robotic arm 22 moves the workpiece 14" beneath the cutting head assembly 12".

Although the example embodiment of FIG. 3 illustrates the jet receiving receptacle 23 as moving relative to a stationary cutting head assembly 12", it is appreciated that a variation of the aforementioned fluid jet system 10" may be provided in which the jet receiving receptacle 23 is fixed relative to the support structure 26 and wherein the linear positioner 30 is provided between the support structure 26 and the cutting head assembly 12" to enable the cutting head assembly 12" to be controllably moved toward and away from the jet receiving receptacle 23 while the robotic arm 22 moves the workpiece 14" beneath the cutting head assembly 12". In still other instances, both of the cutting head assembly 12" and the jet receiving receptacle 23 may remain static throughout a trimming operation.

Figure 4:
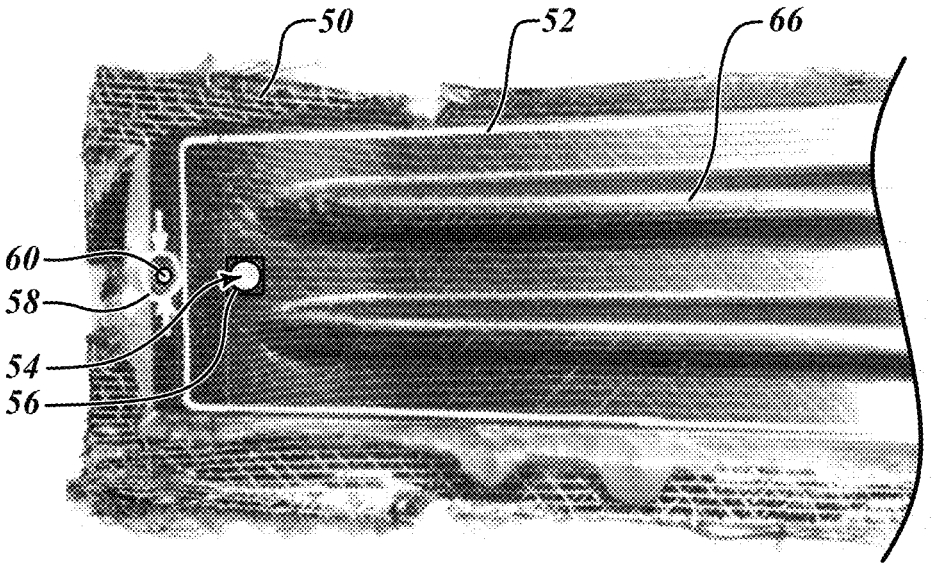
FIG. 4 is a view of an example fiber reinforced polymer composite workpiece which may be trimmed via the methods and systems described herein.

The waterjet cutting systems 10, 10', 10" described herein, and variations thereof, may be used in particular to trim fiber reinforced polymer composite workpieces, such as the example workpiece 50 shown in FIG. 4. The example workpiece 50 comprises a built-up thin shelled carbon fiber reinforced polymer composite workpiece well suited for automotive applications. The example workpiece 50 is shown in an unfinished state in which the fiber reinforced polymer composite material of the workpiece 50 extends beyond a final component profile 52 thereof. An internal feature in the form of an aperture 54 having an outer profile 56 is shown within the confines of the final component profile 52 and may be cut using techniques similar to those described herein for trimming the example workpiece 50 to the final component profile 52. The example workpiece 50 further includes one or more indexing features 60 (e.g., notch, aperture or other indexing feature), shown within the markings labeled 58, for aligning and fixing the workpiece 50 relative to the coordinate system of the waterjet cutting system 10, 10', 10" for subsequent processing of the workpiece, such as trimming the workpiece 50 to the final component profile 52 and cutting any internal features. In some instances, the workpiece 50 may include suitable features for probing and assessing the position and orientation of the workpiece 50. In such instances, it may not be necessary to include indexing features 60 or to otherwise precisely control the position and orientation of the workpiece 50 as the machining path may be generated or otherwise adjusted based on data obtained by probing and assessing the position and orientation of the workpiece 50. The example workpiece 50 shown in FIG. 4 further includes a plurality of raised reinforcement ribs 66 to illustrate one example of numerous variations in surface topography that may be present in the workpiece 50.

Figure 5:
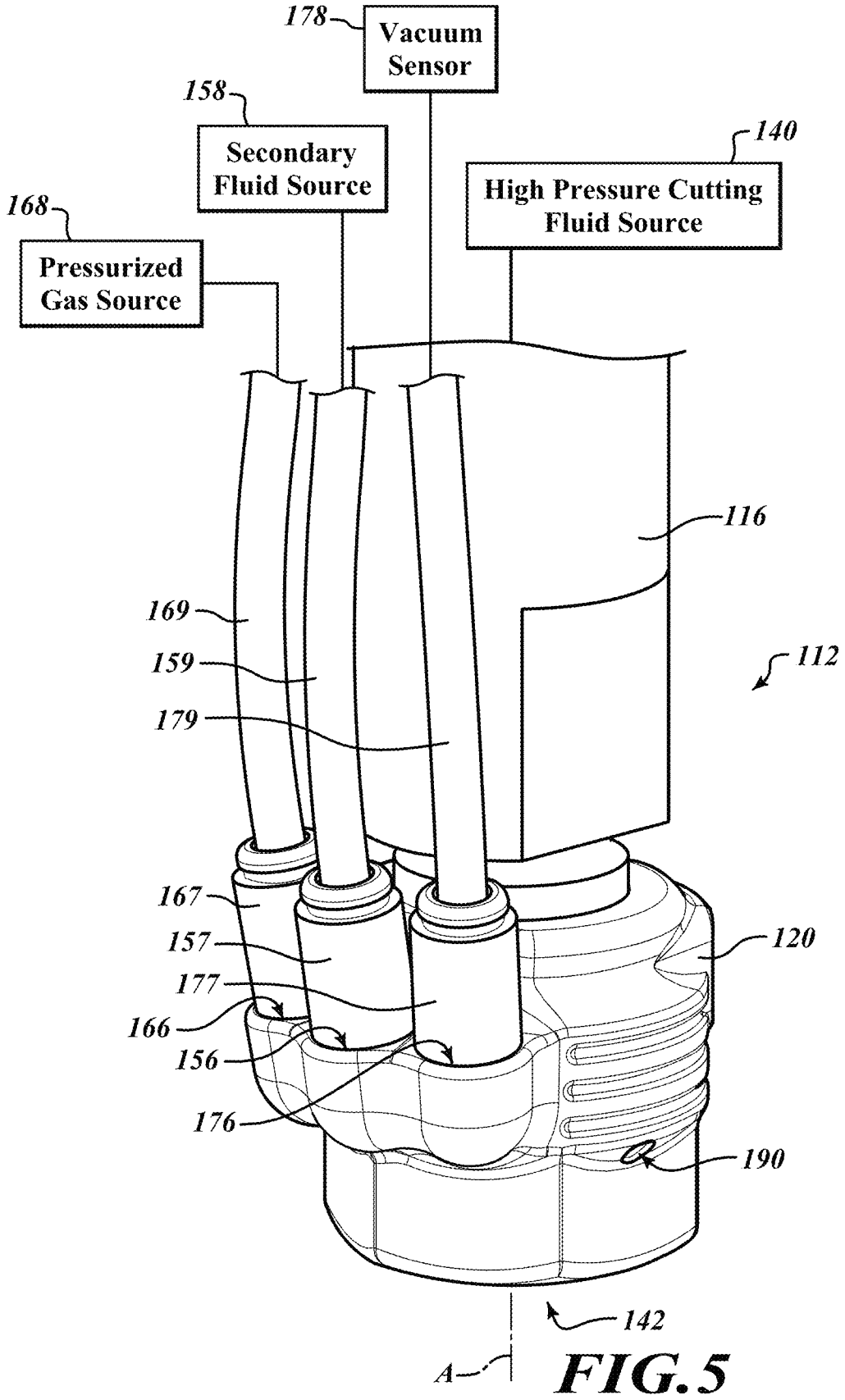
FIG. 5 is a skewed isometric view of a portion of a cutting head assembly, according to one embodiment, that may be used with the example high-pressure waterjet cutting systems shown in FIGS. 1 through 3 for cutting fiber reinforced polymer composite workpieces, such as the example workpiece of FIG. 4.
Figure 6:
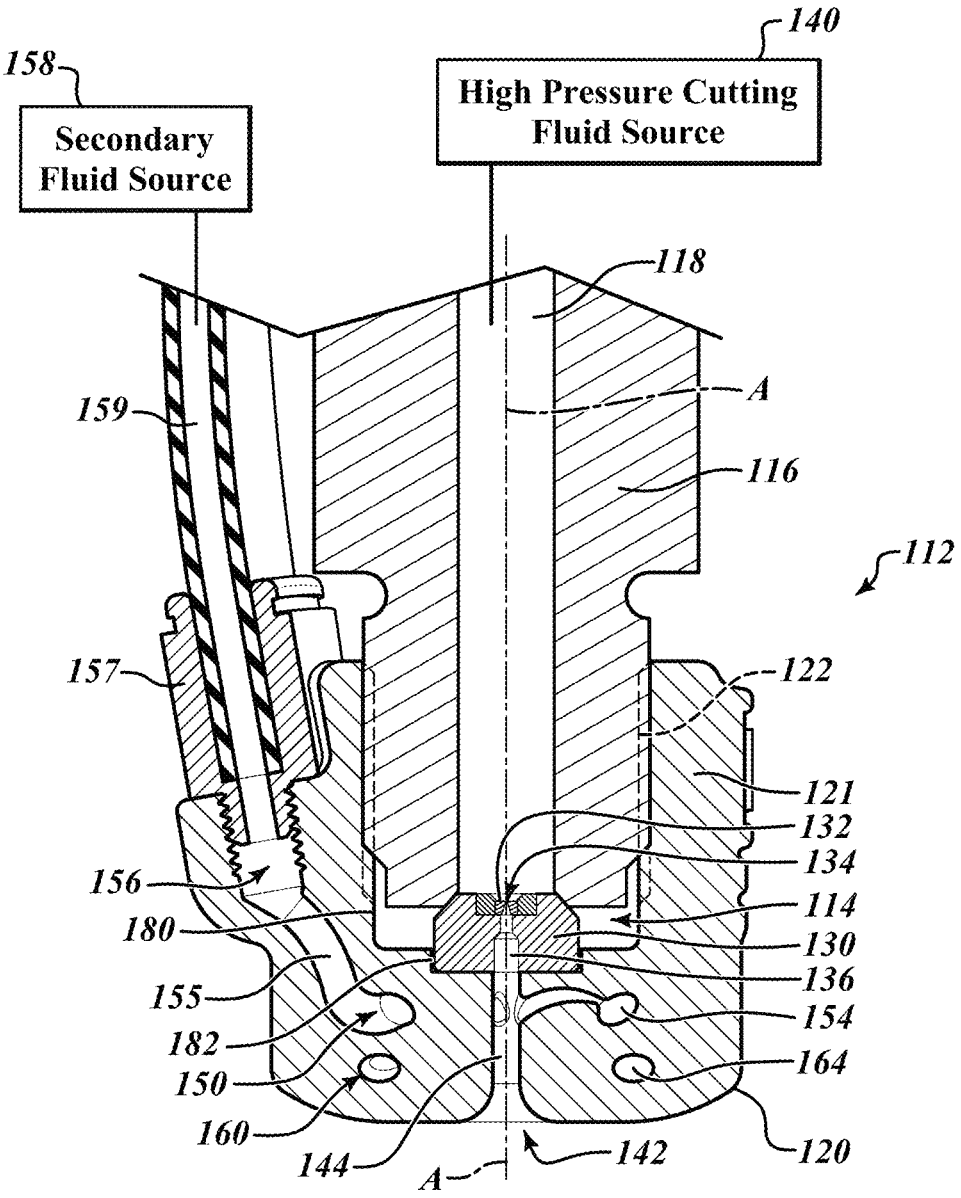
FIG. 6 is a cross-sectional side view of the portion of the cutting head assembly of FIG. 5.
Figure 7:
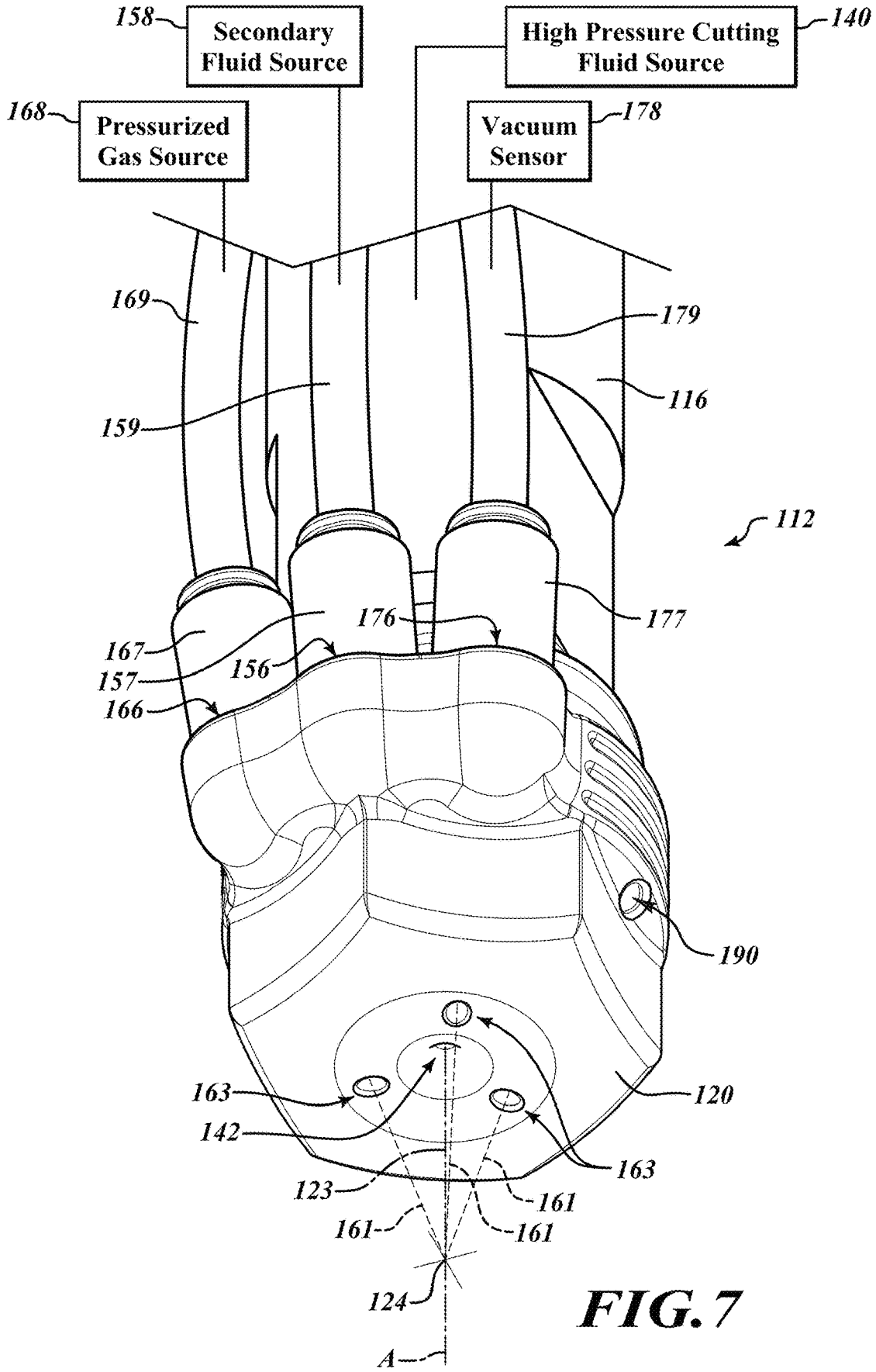
FIG. 7 is a skewed isometric view of the portion of the cutting head assembly of FIG. 5 showing the cutting head assembly from another viewpoint.

FIGS. 5 through 7 show one example of a portion of a cutting head assembly 112 that is particularly well suited for, among other things, cutting workpieces made of fiber reinforced polymer composite materials, such as carbon fiber reinforced polymer composites, with a pure waterjet in liquid form unladened with solid particles. The cutting head assembly 112 may be used with the example high-pressure waterjet cutting systems 10, 10', 10" shown in FIGS. 1 through 3, or may be coupled to other motion systems, including other multi-axis manipulators, for processing workpieces, such as the example carbon fiber reinforced polymer composite workpiece shown in FIG. 4.

With reference to the cross-section shown in FIG. 6, the cutting head assembly 112 includes an orifice unit 114 through which a cutting fluid (i.e., water) passes during operation to generate a high-pressure waterjet. The cutting head assembly 112 further includes a nozzle body 116 having a fluid delivery passage 118 extending therethrough to route cutting fluid (i.e., high-pressure water) toward the orifice unit 114. A nozzle component 120 is coupled to the nozzle body 116 with the orifice unit 114 positioned or sandwiched therebetween. The nozzle component 120 may be removably coupled to the nozzle body 116, for example, by a threaded connection 122 or other coupling arrangement. Coupling of the nozzle component 120 to the nozzle body 116 may urge the orifice unit 114 into engagement with the nozzle body 116 to create a seal therebetween, such as, for example, a metal-to-metal seal.

The nozzle component 120 can have a one-piece construction and can be made, in whole or in part, of one or more metals (e.g., steel, high-strength metals, etc.), metal alloys, or the like. The nozzle component 120 may include threads or other coupling features for coupling to other components of cutting head assembly 112.

The orifice unit 114 may include an orifice mount 130 and an orifice member 132 (e.g., jewel orifice) supported thereby for generating a high-pressure fluid jet as high-pressure fluid (e.g., water) passes through an opening 134 (i.e., an orifice) in the orifice member 132. A fluid jet passage 136 may be provided in the orifice mount 130 downstream of the orifice member 132 through which the jet passes during operation. The orifice mount 130 is fixed with respect to the nozzle component 120 and includes a recess dimensioned to receive and hold the orifice member 132. The orifice member 132, in some embodiments, is a jewel orifice or other fluid jet or cutting stream producing device used to achieve the desired flow characteristics of the resultant fluid jet. The opening of the orifice member 132 can have a diameter in a range of about 0.001 inch (0.025 mm) to about 0.020 inch (0.508 mm). In some embodiments, the orifice member 132 has a diameter in the range of about 0.005 inch (0.127 mm) to about 0.010 inch (0.254 mm).

As shown in FIG. 6, the nozzle body 116 may be coupled to a high-pressure cutting fluid source 140, such as, for example, a source of high-pressure water (e.g., a direct drive or intensifier pump). During operation, high-pressure water from the cutting fluid source 140 may be controllably fed into the fluid delivery passage 118 of the nozzle body 116 and routed toward the orifice unit 114 to generate the jet (not shown), which is ultimately discharged from the cutting head assembly 112 through an outlet 142 at the terminal end of a waterjet passage 144 that extends through the nozzle component 120 along a longitudinal axis A thereof.

Further details of internal passages of the nozzle component 120, including the waterjet passage 144, are shown and described with reference to FIGS. 8 through 10.

Figure 8:
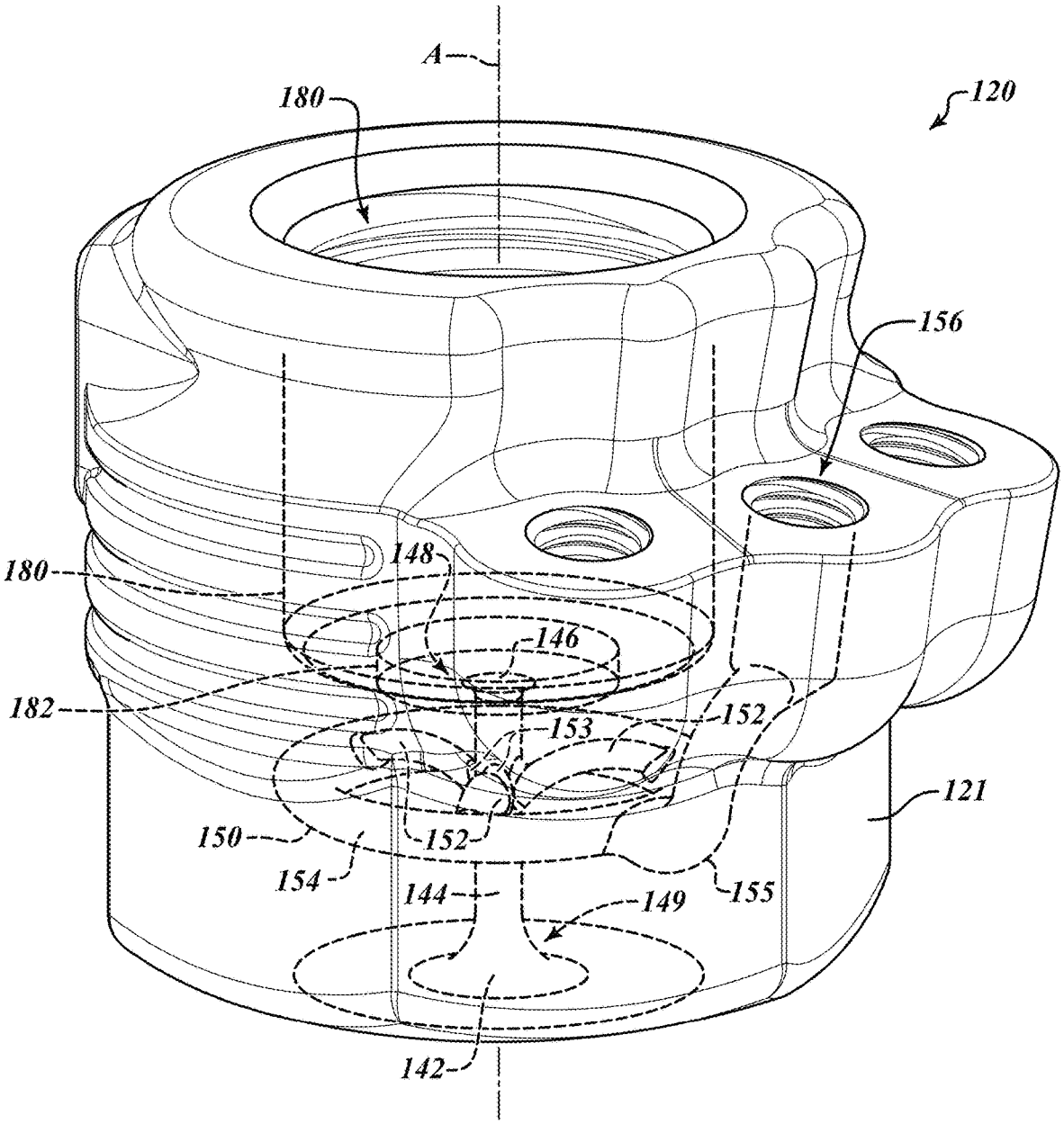
FIG. 8 is a skewed isometric view of a nozzle component of the cutting head assembly shown in FIG. 5 from one viewpoint, showing some of several internal passages thereof.

With reference to FIG. 8, the waterjet passage 144 is shown extending through a body 121 of the nozzle component 120 along longitudinal axis A. The waterjet passage 144 includes an inlet 146 at an upstream end 148 thereof and the outlet 142 at a downstream end 149 thereof.

At least one jet alteration passage 150 may be provided within the nozzle component 120 for adjusting, modifying or otherwise altering the jet that is discharged from the outlet 142 of the nozzle component 120. The jet alteration passage 150 may extend through the body 121 of the nozzle component 120 and intersect with the waterjet passage 144 between the inlet 146 and the outlet 142 thereof to enable such alteration of the waterjet during operation. More particularly, jet alteration passage 150 may extend through the body 121 of the nozzle component 120 and include one or more downstream portions 152 that intersect with the waterjet passage 144 so that a secondary fluid (e.g., water, air or other gas) passed through the jet alteration passage 150 during operation may be directed to impact the fluid jet traveling therethrough. As an example, the jet alteration passage 150 may include a plurality of distinct downstream portions 152 that are arranged such that respective secondary fluid streams discharged therefrom impact the fluid jet traveling through the waterjet passage 144. The example embodiment shown in FIG. 8 includes three distinct downstream portions 152 that are arranged in this manner; however, it is appreciated that two, four or more downstream passage portions 152 may be arranged in such a manner.

Two or more of the downstream portions 152 of the passage 150 may join at an upstream junction 154. The upstream junction 154 may be, for example, a generally annular passage portion that is in fluid communication with an upstream end of each of the downstream passage portions 152, as shown in FIG. 8. The downstream portions 152 of the jet alteration passage 150 may be bridge passageways that extend between the generally annular passage portion and the waterjet passage 144. The bridge passageways may be spaced circumferentially about the waterjet passage 144 in a regular pattern. For example, the downstream portions 152 shown in FIG. 8 include three distinct bridge passageways spaced about the waterjet passage 144 in 120 degree intervals. In other instances, the bridge passageways may be spaced circumferentially about the waterjet passage 144 in an irregular pattern. Moreover, each of the bridge passageways may include a downstream end that is configured to discharge a secondary fluid into the waterjet passage 144 at an angle that is inclined toward the outlet 142 of the waterjet passage 144. In this manner, secondary fluid introduced through the jet alteration passage 150 may impact the jet passing through the waterjet passage 144 at an oblique trajectory.

The downstream portions 152 of the jet alteration passage 150 may be sub-passageways that are configured to simultaneously discharge a secondary fluid from a secondary fluid source 158 (FIGS. 5 through 7) into a path of the waterjet passing through the waterjet passage 144 during operation. Downstream outlets 153 of the sub-passageways may intersect with the waterjet passage 144 such that the outlets 153 collectively define at least a majority of a circumferential section of the waterjet passage 144 which has a height defined by a corresponding height of the outlets 153 intersecting with the waterjet passage 144. In some instances, the downstream outlets 153 of the sub-passageways may intersect with the waterjet passage 144 such that the outlets 153 collectively define at least seventy-five percent of the circumferential section of the waterjet passage 144. Moreover, in some instances, the outlets 153 may overlap or nearly overlap with each other at the intersection with the waterjet passage 144.

The upstream junction 154 of the jet alteration passage 150 may be in fluid communication with a port 156 directly or via an intermediate portion 155. The port 156 may be provided for coupling the jet alteration passage 150 of the nozzle component 120 to the secondary fluid source 158 (FIGS. 5 through 7). With reference to FIG. 5 or FIG. 7, the port 156 may be threaded or otherwise configured to receive a fitting, adapter or other connector 157 for coupling the jet alteration passage 150 to the secondary fluid source 158 via a supply conduit 159. Intermediate valves (not shown) or other fluid control devices may be provided to assist in controlling the delivery of a secondary fluid (e.g., water, air or other gas) to the jet alteration passage 150 and ultimately into the waterjet passing through the waterjet passage 144. In other instances, the port 156 may be provided for coupling the jet alteration passage 150 to a vacuum source (not shown) for generating a vacuum within the jet alteration passage 150 sufficient to alter flow characteristics of the waterjet passing through the waterjet passage 144. The jet alteration passage 150 may be used intermittently or continuously during a portion of a cutting operation to adjust jet coherence or other jet characteristics. For example, in some instances, a secondary fluid, such as, for example, water or air, may be introduced into the waterjet via the jet alteration passage 150 during a piercing or drilling operation.

Figure 9:
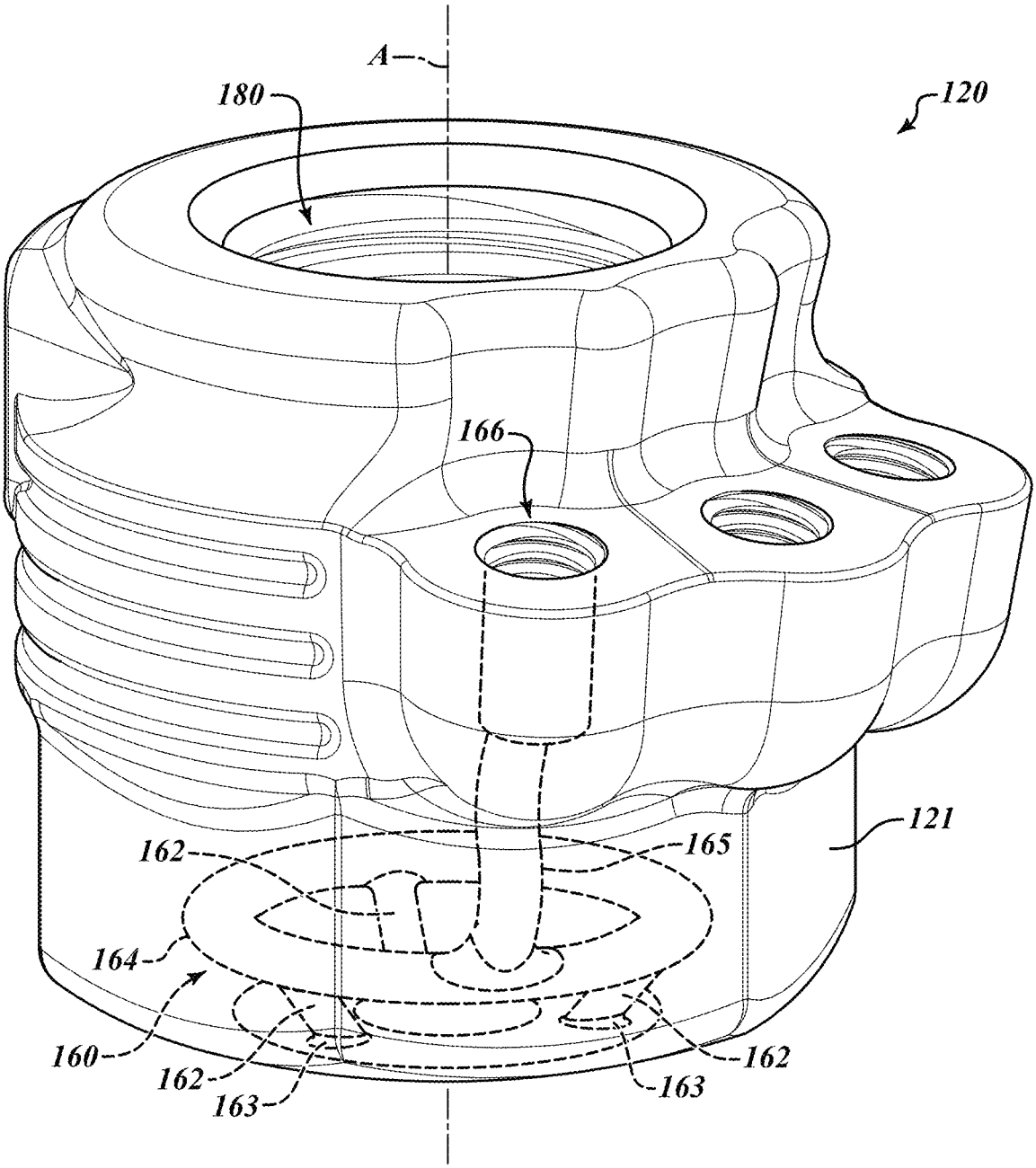
FIG. 9 is a skewed isometric view of the nozzle component of FIG. 8 from the same viewpoint, showing other internal passages thereof.

With reference to FIG. 9, an environment control passage 160 may be provided within the nozzle component 120 for discharging a pressurized gas stream to impinge on an exposed surface of a workpiece at or adjacent where the waterjet pierces or cuts through the workpiece during a cutting operation (i.e., the waterjet impingement location). The environment control passage 160 may extend through a body 121 of the nozzle component 120 and include one or more downstream portions 162 that are aligned relative to the waterjet passage 144 (FIGS. 6, 8 and 10) so that air or other gas passed through the environment control passage 160 during operation is directed to impinge on the workpiece at or adjacent the waterjet impingement location. As an example, the environment control passage 160 may include a plurality of distinct downstream portions 162 that are arranged such that respective gas streams discharged from outlets 163 thereof converge in a downstream direction at or near the waterjet impingement location.

With reference to FIG. 7, the gas streams discharged from the outlets 163 of the downstream portions 162 may follow respective trajectories 161 that intersect with a trajectory 123 of the discharged jet. The trajectories 161 of the gas streams may intersect with a trajectory 123 of the discharged jet at an intersection location 124, for example, which is at or near the focal point or standoff distance of the waterjet cutting system 10, 10', 10". In some instances, the intersection location 124 may be slightly short of the focal point or standoff distance. In other instances, the intersection location 124 may be slightly beyond the focal point or standoff distance such that each respective gas stream trajectory 161 intersects with the exposed surface of the workpiece prior to reaching the waterjet impingement location and is then directed by the surface of the workpiece to change direction and flow across the waterjet impingement location.

Although the example environment control passage 160 shown in FIG. 9 shows three distinct downstream portions 162 that converge in a downstream direction, it is appreciated that two, four or more downstream passage portions 162 may be arranged in such a manner. In other instances, a single downstream passage portion 162 may be provided. In addition, in some embodiments, one or more gas streams may be directed generally collinearly with the discharged jet to form a shroud around the jet.

With continued reference to FIG. 9, two or more of the downstream portions 162 of the passage 160 may join at an upstream junction 164. The upstream junction 164 may be, for example, a generally annular passage that is in fluid communication with an upstream end of each of the downstream passage portions 162, as shown in FIG. 9. The downstream passage portions 162 of the environment control passage 160 may be distinct sub-passageways that extend between the generally annular passage portion and an external environment of the nozzle component 120. The downstream passage portions 162 of the environment control passage 160 may be spaced circumferentially about the waterjet passage 144 in a regular pattern. For example, the downstream passage portions 162 shown in FIG. 9 include three distinct sub-passageways spaced about the waterjet passage 144 in 120 degree intervals. In other instances, the downstream passage portions 162 may be spaced circumferentially about the waterjet passage 144 in an irregular pattern.

In some instances, the downstream passage portions 162 may be configured to simultaneously discharge air or other gas from a common pressurized gas source 168 (FIGS. 5 and 7) to impinge on the workpiece at or adjacent the waterjet impingement location. In this manner, pressurized air or other gas introduced through the environment control passage 160 may impinge or impact on an exposed surface of the workpiece and clear the same of any obstructions (e.g., standing water droplets or particulate matter) so that the waterjet may cut through the workpiece in a particularly precise manner. Again, in other embodiments, one or more gas streams may be directed generally collinearly with the discharged jet to form a shroud around the jet for maintaining an environment around the cutting location to be free of obstructions such as standing water droplets or particulate matter.

The upstream junction 164 may be in fluid communication with a port 166 directly or via an intermediate portion 165. The port 166 may be provided for coupling the environment control passage 160 of the nozzle component 120 to a pressurized gas source 168 (FIGS. 5 and 7). With reference to FIG. 5 or FIG. 7, the port 166 may be threaded or otherwise configured to receive a fitting, adapter or other connector 167 for coupling the environmental control passage 160 to the pressurized gas source 168 via a supply conduit 169. Intermediate valves (not shown) or other fluid control devices may be provided to assist in controlling the delivery of pressurized gas to the environment control passage 160 and ultimately to the exposed surface of the workpiece that is to be processed.

Figure 10:
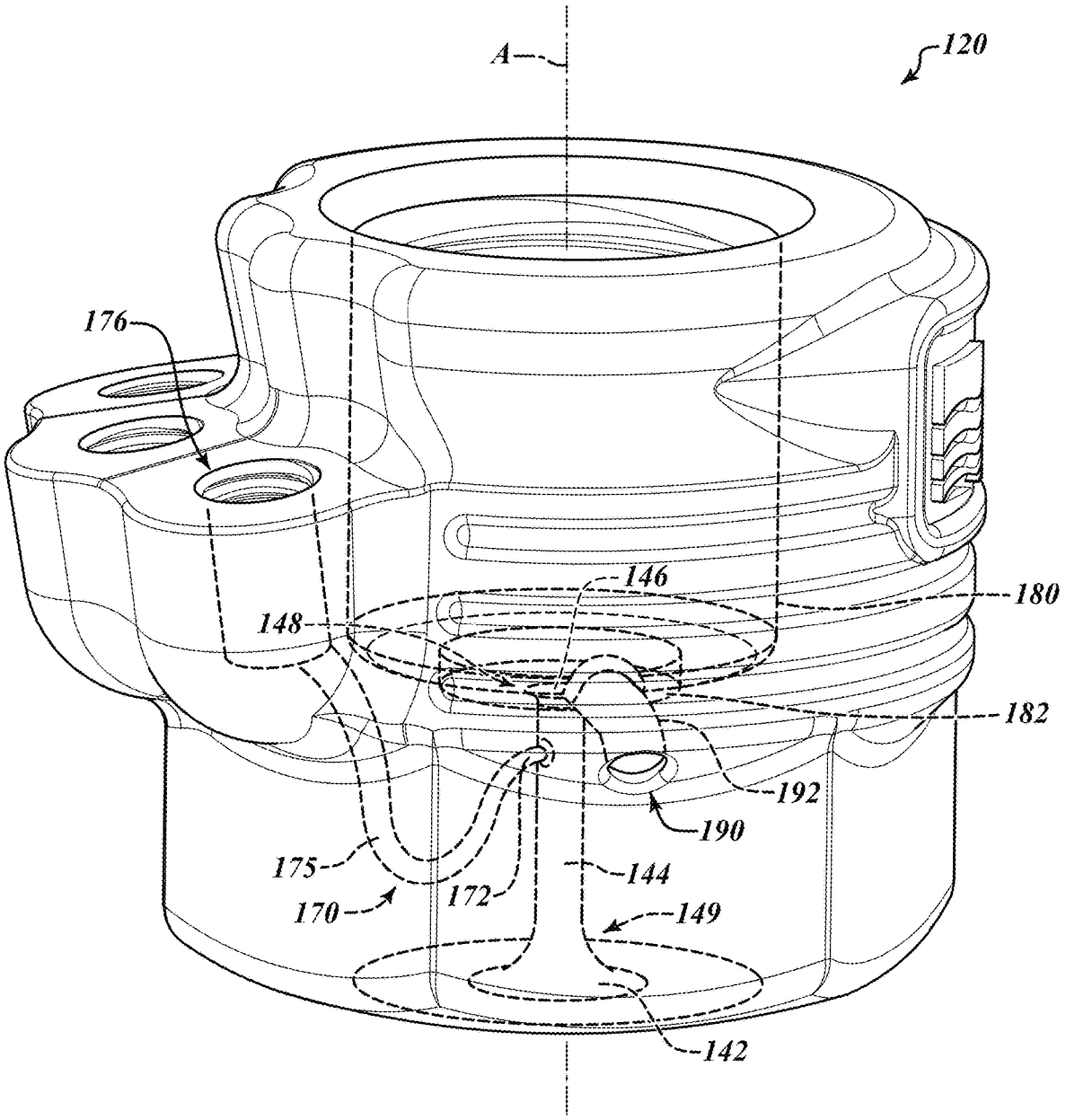
FIG. 10 is a skewed isometric view of the nozzle component of FIG. 8 from a different viewpoint, showing other internal passages thereof.

With reference to FIG. 10, a condition detection passage 170 may be provided within the nozzle component 120 to enable detection of a condition of the orifice member 132 (FIG. 6) that is used to generate the waterjet. The condition detection passage 170 may extend through the body 121 of the nozzle component 120 and include one or more downstream portions 172 that intersect with the waterjet passage 144 at an upstream end thereof so that a vacuum level may be sensed that is indicative of a condition of the orifice member 132. As an example, the condition detection passage 170 may include a curvilinear passageway 175 that intersects with the waterjet passage 144 near and downstream of an outlet of the fluid jet passage 136 of the orifice mount 130. The condition detection passage 170 may be in fluid communication with a port 176 that may be provided for coupling the condition detection passage 170 of the nozzle component 120 to a vacuum sensor 178, as shown, for example, in FIGS. 5 and 7. With reference to FIG. 5 or FIG. 7, the port 176 may be threaded or otherwise configured to receive a fitting, adapter or other connector 177 for coupling the condition detection passage 170 to the vacuum sensor 178 via a supply conduit 179.

With reference to FIG. 6, the nozzle component 120 may further include a nozzle body cavity 180 for receiving a downstream end of the nozzle body 116 and an orifice mount receiving cavity or recess 182 to receive the orifice mount 130 of the orifice unit 114 when assembled. The orifice mount receiving cavity or recess 182 may be sized to assist in aligning the orifice unit 114 along the axis A of the waterjet passage 144. For instance, orifice mount receiving cavity or recess 182 may comprise a generally cylindrical recess that is sized to insertably receive the orifice mount 130 of the orifice unit 114. The orifice receiving cavity or recess 182 may be formed within a downstream end of the nozzle body cavity 180.

With reference to FIG. 10, the nozzle component 120 may further include a vent passage 192 extending between the nozzle body cavity 180 and an external environment of the nozzle component 120 at vent outlet 190. The vent passage 192 and vent outlet 190 may serve to relieve pressure that may otherwise build within an internal cavity formed around the orifice unit 114 between the nozzle body 116 and the nozzle component 120, as best shown in FIG. 6.

According to the embodiment shown in FIGS. 5 through 10, the nozzle component 120 has a unitary or one-piece body 121 that may be formed from an additive manufacturing or casting process using a material with material property characteristics (e.g., strength) suitable for high-pressure waterjet applications. For instance, in some embodiments, the nozzle component 120 may be formed by a direct metal laser sintering process using 15-5 stainless steel or other steel materials. In other instances, a nozzle component 120 may include a unitary or one-piece body formed by other machining or manufacturing processes, such as, for example, subtractive machining processes (e.g., drilling, milling, grinding, etc.). The nozzle component 120 may undergo heat treatment or other manufacturing processes to alter the physical properties of the nozzle component 120, such as, for example, increasing the hardness of the nozzle component 120. Although the example nozzle component 120 is shown as having a generally cylindrical body with an array of ports 156, 166, 176 protruding from a side thereof, it is appreciated that in other embodiments, the nozzle component 120 may take on different forms and may have ports 156, 166, 176 located at different positions and with different orientations.

In view of the above, it will be appreciated that a nozzle component 120 for high-pressure waterjet cutting systems 10, 10', 10" may be provided in accordance with various aspects described herein, which is particularly well adapted for receiving a high-pressure pure waterjet unladened with abrasive particles or other solid particles, and optionally receiving a flow of secondary fluid and/or a flow of pressurized gas to enable jet coherence adjustment and/or control of a cutting environment while discharging the pure waterjet towards an exposed surface of a fiber reinforced polymer composite workpiece for trimming the same. The nozzle component 120 may include complex passages (e.g., passages with curvilinear trajectories and/or varying cross-sectional shapes and/or sizes) that are well suited for routing fluid or other matter in particularly efficient and reliable form factors. Benefits of embodiments of such a nozzle component 120 include the ability to provide enhanced flow characteristics and/or to reduce turbulence within the internal passages. This can be particularly advantageous when space constraints might not otherwise provide sufficient space for developing favorable flow characteristics. For example, a low profile nozzle component 120 may be desired when cutting workpieces within confined spaces. Including a nozzle component 120 with internal passages as described herein can enable such a low profile nozzle component 120 to generate a fluid jet with desired jet characteristics despite such space constraints. In addition, the fatigue life of such a nozzle component 120 may be extended by eliminating sharp corners, abrupt transitions and other stress concentrating features. These and other benefits may be provided by the various aspects of the nozzle component 120 described herein.

Figure 11A:
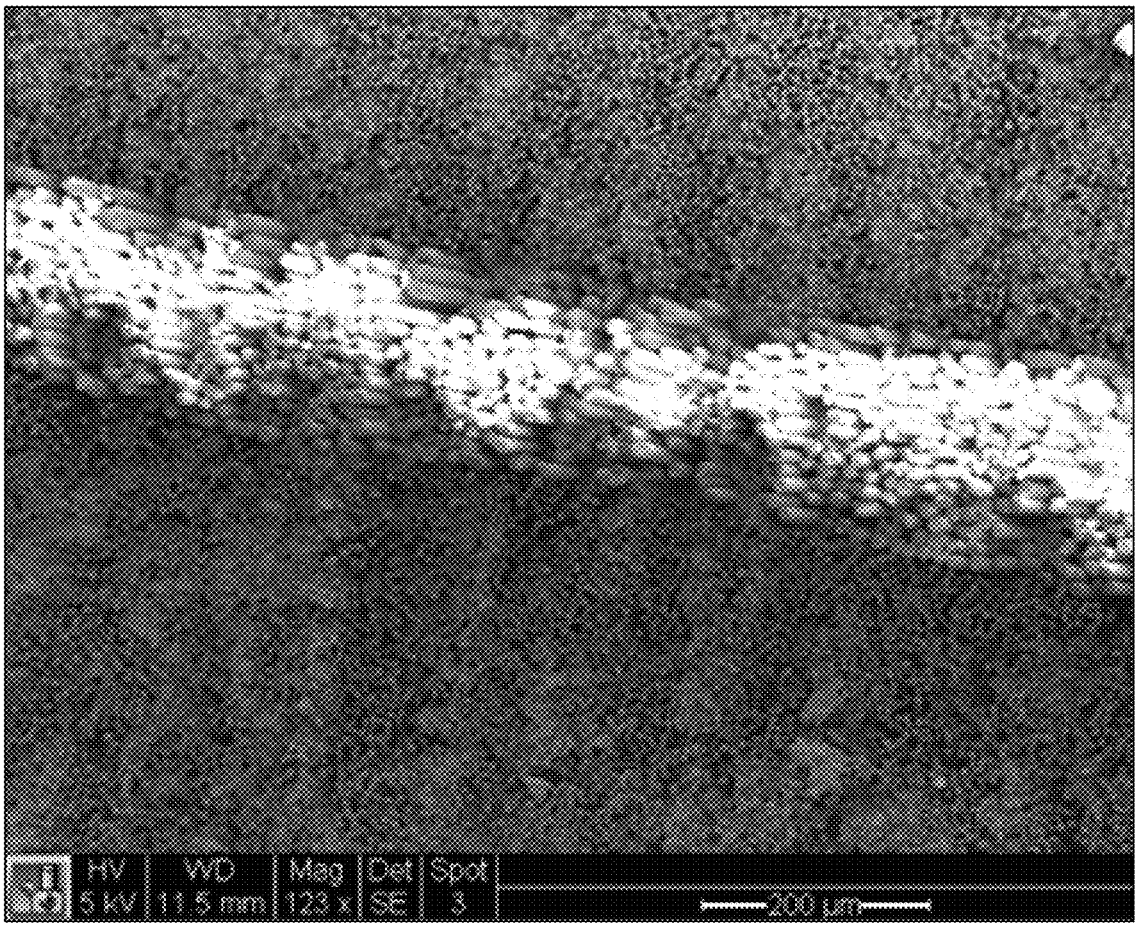
FIGS. 11A-11C are microscopic images of an edge of a fiber reinforced polymer composite workpiece cut with a pure waterjet in accordance with trimming methods disclosed herein.
Figure 11B:
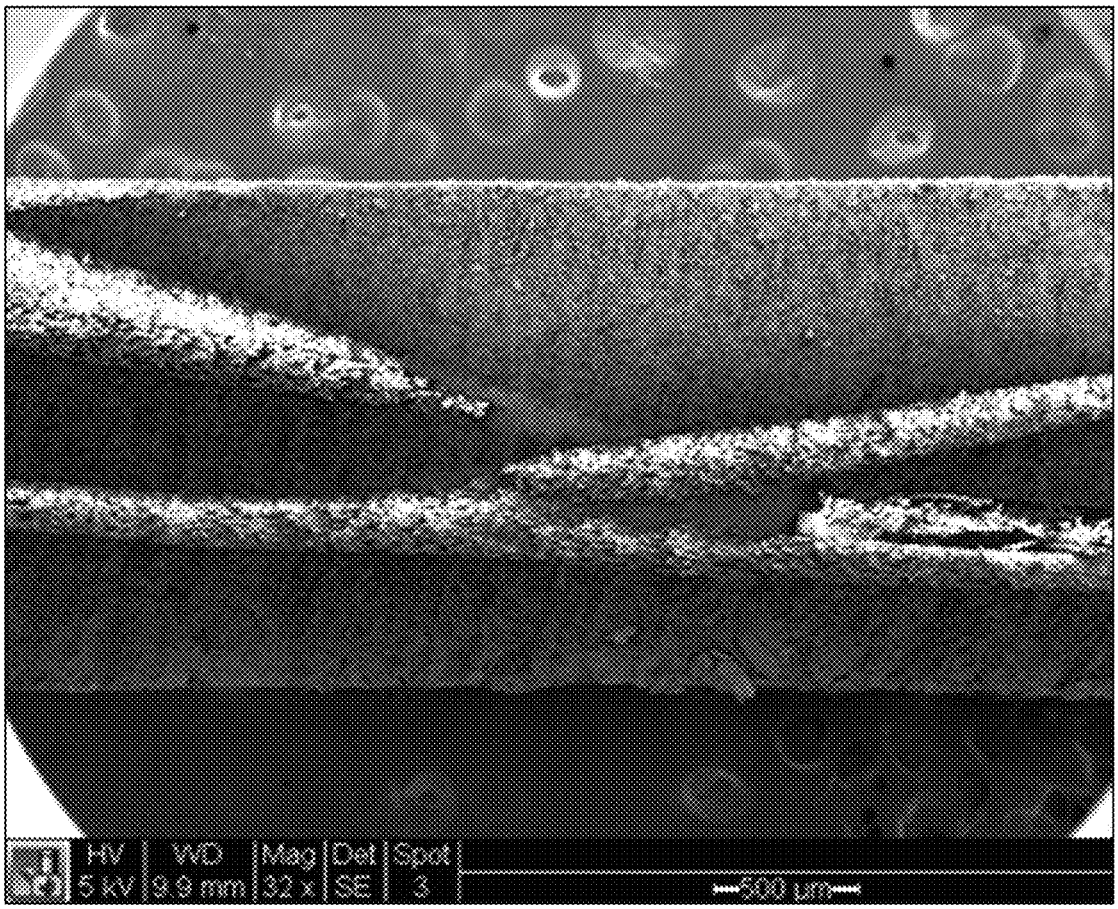
Figure 11C:
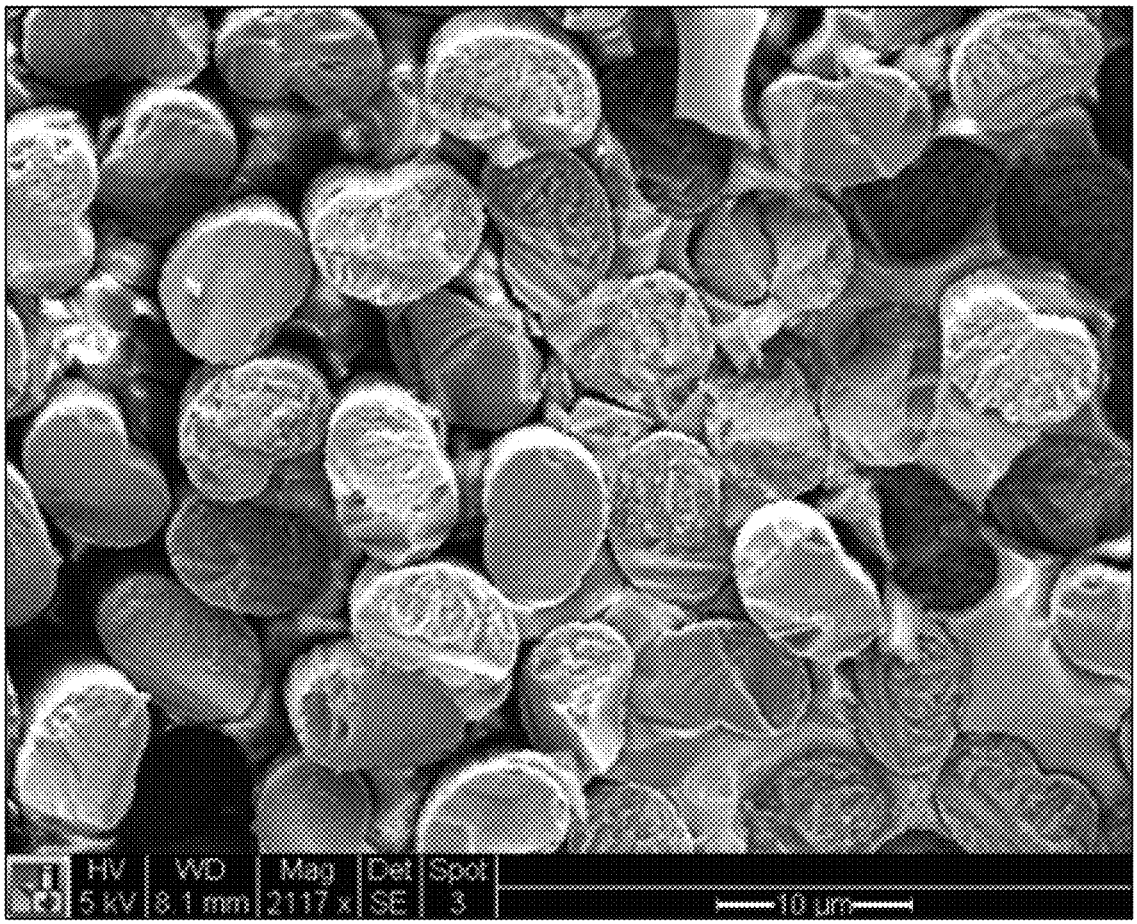

In accordance with the various waterjet cutting systems 10, 10', 10," cutting head assemblies 12, 12', 12" and nozzle components 120 described herein, methods that are particularly well adapted for trimming a fiber reinforced polymer composite workpiece are provided. One example method includes: providing a fiber reinforced polymer composite workpiece in an unfinished state in which fiber reinforced polymer composite material of the workpiece extends beyond a final component profile thereof; generating a pure waterjet via a cutting head in liquid phase unladened with solid particles at an operating pressure of at least 60,000 psi; directing the pure waterjet to pass through the fiber reinforced polymer composite workpiece; and moving one of the cutting head and the fiber reinforced polymer composite workpiece relative to the other along a predetermined path while maintaining the operating pressure of at least 60,000 psi such that the pure waterjet trims the fiber reinforced polymer composite material to the final component profile without delamination, splintering, fraying or unacceptable fiber pullout or fiber fracture. Trimming the workpiece to a final component profile without delamination, splintering, fraying or unacceptable fiber pullout or fiber fracture may be evidenced by an edge and adjacent surfaces which are free from delamination, splintering and fraying and which, under microscopic evaluation, show fibers with clean cuts without fiber damage or pullout, as shown for example in representative FIGS. 11A-11C. According to some embodiments, the edge of the trimmed workpiece may have a surface roughness having an $R_a$ value of about 22±5 microns or an $R_z$ value of about 128±20 microns.

According to some embodiments, moving the cutting head and the fiber reinforced polymer composite workpiece relative to each other along the predetermined path may include moving at a cutting speed based at least in part on a thickness of the fiber reinforced polymer composite workpiece and a magnitude of the operating pressure.

Figure 12:
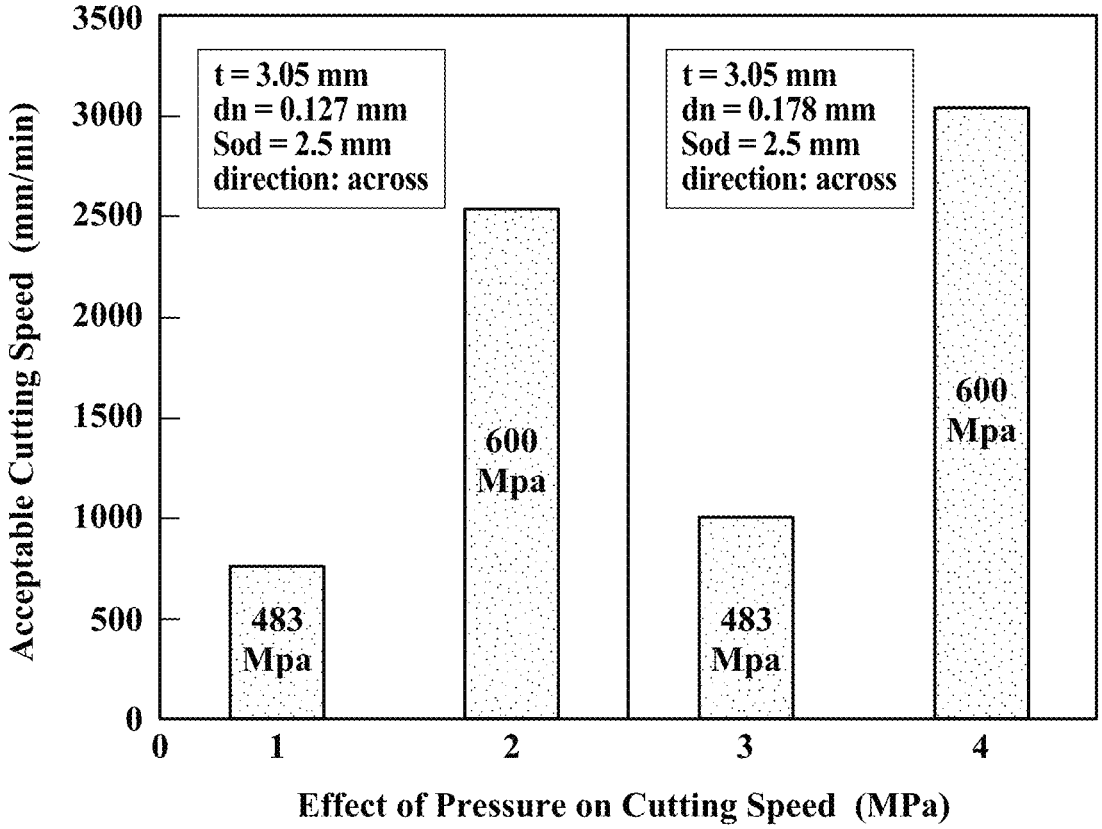
FIG. 12 is a graph illustrating the effect of pressure and orifice size on acceptable cutting speed.

Generally, holding other variables, such as thickness (t) of the workpiece and standoff distance (Sod), constant, cutting speed may be increased with increases in operating pressures (p) above 60,000 psi. To illustrate this relationship, example cuts were performed on a carbon fiber reinforced polymer workpiece with a pure waterjet unladened with solid particles under similar conditions at operating pressures of about 70,000 psi (483 MPa) and about 87,000 psi (600 MPa) for each of two different orifice sizes (dn), namely 0.005 inch (0.127 mm) and 0.007 (0.178 mm), to assess acceptable cutting speeds. The results are shown on the graph of FIG. 12. Under the tested conditions, significantly higher acceptable cutting speeds were enabled when increasing the operating pressure from about 70,000 psi (483 MPa) to about 87,000 psi (600 MPa). In addition, higher acceptable cutting speeds were enabled when increasing the orifice size from 0.005 inch (0.127 mm) to 0.007 inch (0.178 mm), but to a less significant degree when compared to the effects of changing the operating pressure. Acceptable cutting speeds were determined by identifying cutting speeds which produced workpiece edge quality lacking appreciable delamination, splintering, fraying or unacceptable fiber pullout or fiber fracture.

Figure 13:
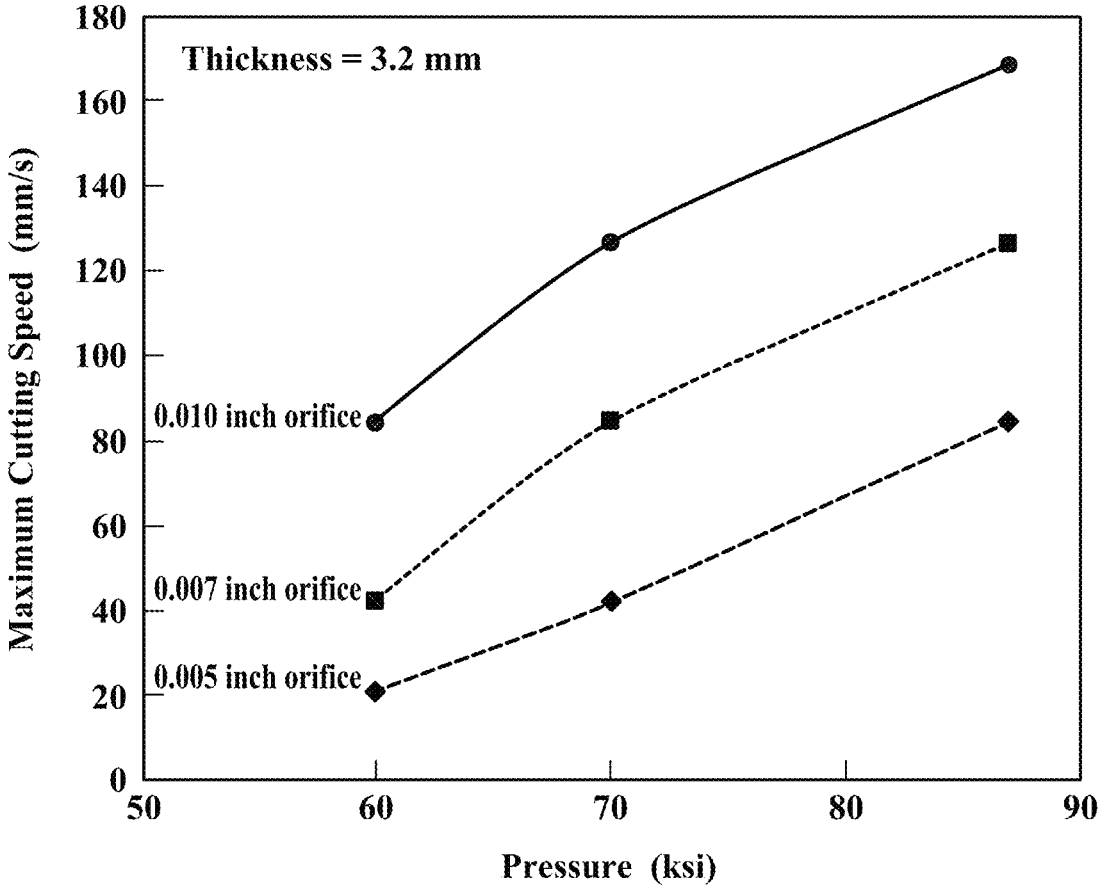
FIG. 13 is a graph illustrating variations in maximum cutting speed in relation to operating pressure and orifice size.

To further illustrate the relationship between acceptable or maximum cutting speed and orifice size (dn), example cuts were performed on a carbon fiber reinforced polymer workpiece having a material thickness (t) of about 0.125 inch (3.2 mm) with a pure waterjet unladened with solid particles under similar conditions at operating pressures of about 60,000 psi (414 MPa); about 70,000 psi (483 MPa); and about 87,000 psi (600 MPa) for each of three different orifice sizes (dn), namely 0.005 inch (0.127 mm); 0.007 inch (0.178 mm); and 0.010 inch (0.254 mm). The results are shown on the graph of FIG. 13. Under the tested conditions, higher cutting speeds were enabled with increasing orifice size for orifices in a range of about 0.005 inch to about 0.010 inch. Thus, for at least a portion of the trimming method, the cutting speed may be selected based at least in part an orifice size of an orifice member used to generate the pure waterjet, the cutting speed increasing with increases in the orifice size for orifice sizes in a range of about 0.005 inch to about 0.010 inch.

Figure 14:
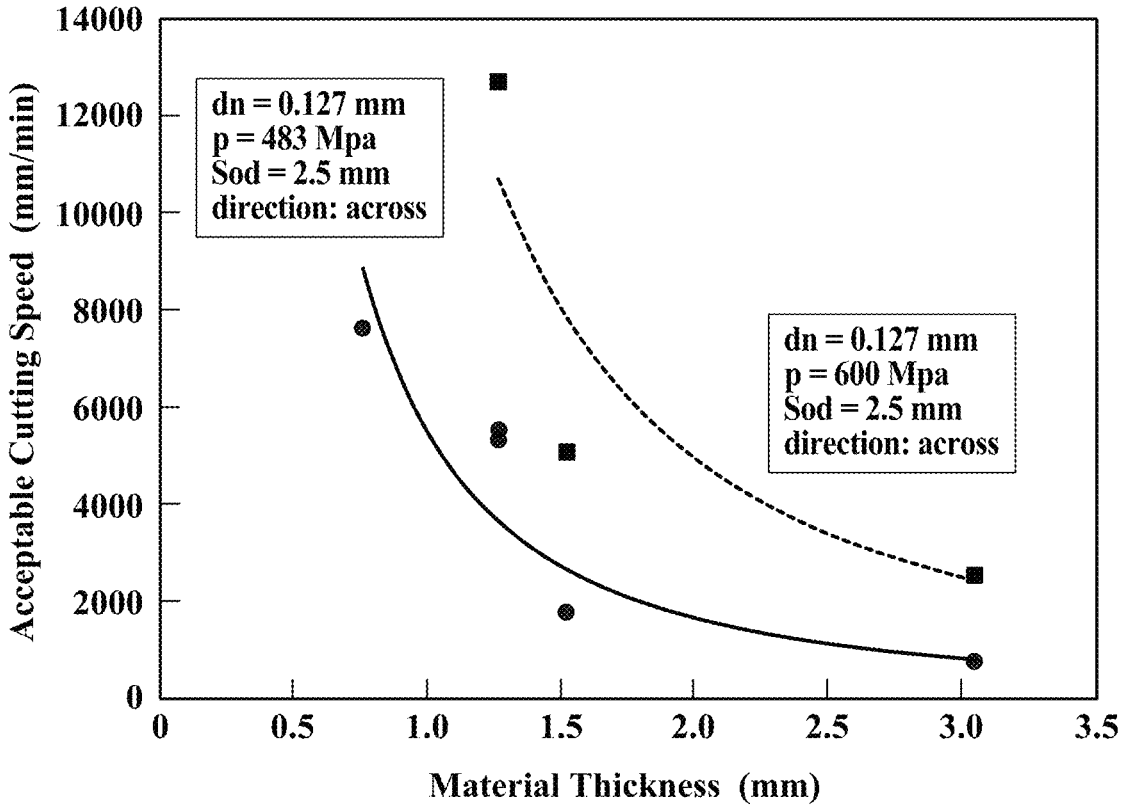
FIG. 14 is a graph illustrating variations in acceptable cutting speed in relation to material thickness for each of two different operating pressures.

Generally, holding other variables, such as orifice size (dn) and standoff distance (Sod), constant, acceptable cutting speed may be increased with increases in operating pressures (p) above 60,000 psi and may be increased with reductions in material thickness (t). To illustrate these relationships, example cuts were performed on carbon fiber reinforced polymer workpieces with a pure waterjet unladened with solid particles under similar conditions at operating pressures of about 70,000 psi (483 MPa) and about 87,000 psi (600 MPa) for various material thicknesses (t) to assess acceptable cutting speeds. The results are shown on the graph of FIG. 14. Under the tested conditions, significantly higher acceptable cutting speeds were again enabled when increasing the operating pressure from about 70,000 psi (483 MPa) to about 87,000 psi (600 MPa). In addition, higher acceptable cutting speeds were enabled when reducing the material thickness. Again, acceptable cutting speeds were determined by identifying cutting speeds which produced workpiece edge quality lacking appreciable delamination, splintering, fraying or unacceptable fiber pullout or fiber fracture.

Figure 15:
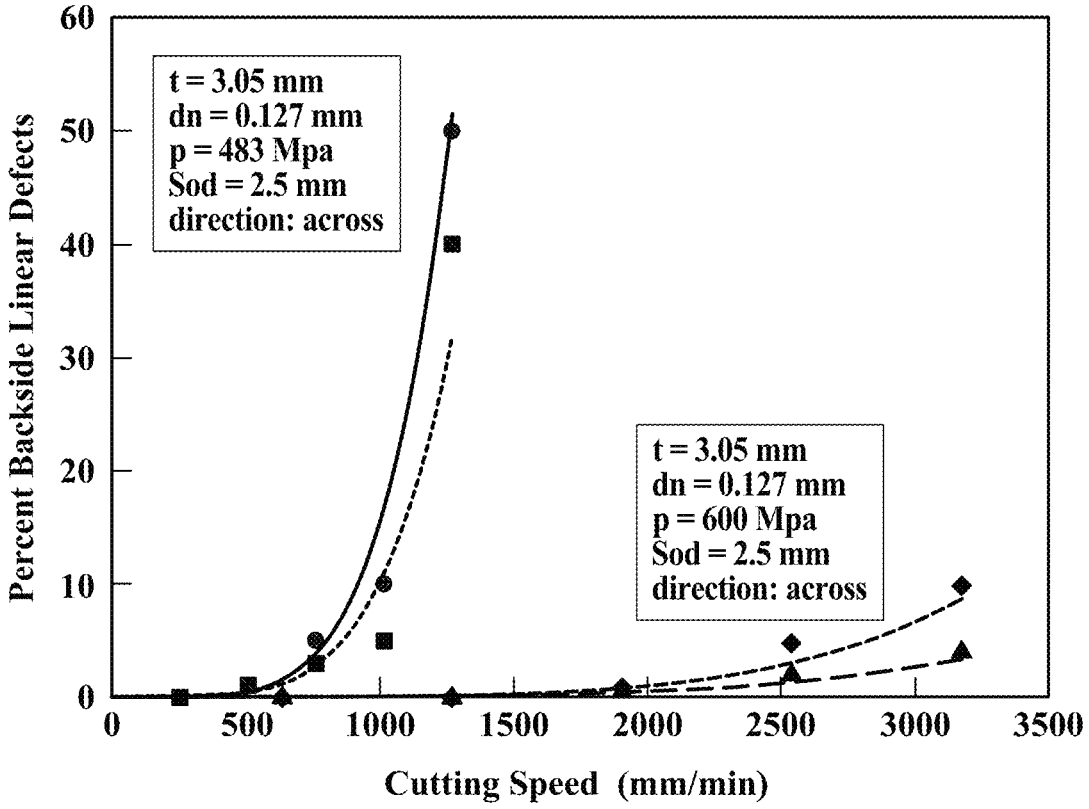
FIG. 15 is a graph charting a percentage of backside linear defects consisting of small localized areas of delamination in relation to cutting speed under different operating parameters.

To further illustrate the relationship between acceptable or maximum cutting speed and operating pressure (p), example cuts were performed on carbon fiber reinforced polymer workpieces having a material thickness (t) of about 0.120 inch (3.05 mm) with a pure waterjet unladened with solid particles under similar conditions at operating pressures of about 70,000 psi (483 MPa) and about 87,000 psi (600 MPa) and percentages of backside linear defects consisting of small localized areas of delamination were recorded for each of two series of tests at five different linear cutting speeds. The results are shown on the graph of FIG. 15. Under the tested conditions, cutting the carbon fiber reinforced polymer workpiece with an operating pressure (p) of about 87,000 psi (600 MPa) resulted in a significantly smaller percentage of linear defects than with an operating pressure (p) of about 70,000 psi (483 MPa) while enabling much higher acceptable cutting speeds. Thus, in some embodiments, a trimming method may be advantageously performed while maintaining operating pressure at or above 87,000 psi (600 MPa) to minimize or eliminate backside linear defects.

In view of the above, for at least a portion of the trimming method, the cutting speed may be selected relative to, among other factors, material thickness and operating pressure to satisfy at least one of the following sets of conditions when cutting medium strength carbon fiber reinforced polymer composite workpieces or workpieces made of fiber reinforced polymer composites with similar material characteristics: the cutting speed is between about 3,000 mm/min and about 6,000 mm/min when the operating pressure is between about 60,000 psi and about 75,000 psi and the material thickness is about 1.00 mm±0.50 mm; the cutting speed is between about 500 mm/min and about 1,000 mm/min, when the operating pressure is between about 60,000 psi and about 75,000 psi and the material thickness is about 2.50 mm±1.00 mm; the cutting speed is between about 100 mm/min and about 250 mm/min when the operating pressure is between about 60,000 psi and about 75,000 psi and the material thickness is about 5.5 mm±2.00 mm; and the cutting speed is between about 20 mm/min and about 40 mm/min when the operating pressure is between about 60,000 psi and about 75,000 psi and the material thickness is about 10.0 mm±2.50 mm. In other instances, for at least a portion of the trimming method, the cutting speed may be selected relative to, among other factors, the material thickness and the operating pressure to satisfy at least one of the following sets of conditions when cutting medium strength carbon fiber reinforced polymer composite workpieces or workpieces made of fiber reinforced polymer composites with similar material characteristics: the cutting speed is between about 8,000 mm/min and about 12,000 mm/min when the operating pressure is between about 75,000 psi and about 90,000 psi and the material thickness is about 1.00 mm±0.50 mm; the cutting speed is between about 1,200 mm/min and about 2,000 mm/min when the operating pressure is between about 75,000 psi and about 90,000 psi and the material thickness is about 2.50 mm±1.00 mm; the cutting speed is between about 300 mm/min and about 500 mm/min when the operating pressure is between about 75,000 psi and about 90,000 psi and the material thickness is about 5.5 mm±2.00 mm; and the cutting speed is between about 75 mm/min and about 120 mm/min when the operating pressure is between about 75,000 psi and about 90,000 psi and the material thickness is about 10.0 mm±2.50 mm.

Acceptable or maximum cutting speed may also be based at least in part on a type of fiber, a type of matrix material, and/or a type of fabrication scheme of the fiber reinforced polymer composite workpiece. For example, the fiber reinforced polymer composite workpiece may include carbon fibers, glass fibers, boron fibers, polyamide fibers or other types of fibers, may include different types of polymer matrix materials, and may be built up from layers of fibers, tape or cloth impregnated with the matrix materials, thereby resulting in reinforced polymer composite workpieces having different material characteristics, such as strength or hardness. Cutting speed may be selected based at least in part on such material characteristics. For example, relatively slower cutting speeds may be selected for harder composite materials, such as, for example, higher strength carbon fiber polymer composites compared to lower strength polyamide fiber polymer composites.

According to some embodiments, the trimming method may include maintaining a linear power density (jet power divided by jet diameter) of the pure waterjet above a threshold linear power density sufficient to cut the fiber reinforced polymer composite workpiece along the final component profile without delamination, splintering, fraying or unacceptable fiber pullout or fiber fracture. The threshold linear power density may be dependent upon a variety of factors including material type and material thickness, and the actual linear power density of the pure waterjet may be determined mainly by the operating pressure and orifice size.

According to some embodiments, the trimming method may include controlling a cutting speed based on a plurality of operating parameters including material thickness, material type, operating pressure, and orifice size. For example, the cutting speed may be set relatively higher for thinner workpieces, for softer composites, under higher operating pressures or when using larger orifice sizes. Other parameters may include standoff distance and tolerance level. For example, some workpieces may require tighter tolerance control and the cutting speed may be adjusted accordingly (i.e., lower cutting speeds for stricter tolerances and higher cutting speeds for looser tolerances). Tighter tolerance control may be reflected in the amount of surface roughness desired or tolerated for a given application of the trimming methods described herein. Still other parameters may include a complexity of the cutting path, such as the degree of arcs or corners the jet is negotiating while cutting. For example, relatively slower cutting speeds may be used when approaching and navigating tighter corners and smaller radius arcs to assist in preventing delamination, while relatively faster cutting speeds may be used on straighter or straight cuts.

According to some embodiments, rather than preventing all delamination, a trimming method may comprise controlling the linear cutting speed to maintain backside linear defects consisting of small localized areas of delamination below a threshold acceptable defect level, such as, for example, less than 10% backside linear defects or less than 5% backside linear defects.

According to some embodiments, the trimming method may further comprise piercing the fiber reinforced polymer composite workpiece at an area within the final component profile (e.g., at the location of aperture 54 of FIG. 4) at any operating pressure (including below 60,000 psi) and creating an aperture surrounded by a localized area of delamination of an acceptable size, and thereafter moving one of the cutting head and the fiber reinforced polymer composite workpiece relative to the other along another predetermined path while maintaining an operating pressure of at least 60,000 psi such that the pure waterjet cuts an internal feature within the fiber reinforced polymer composite material and removes the localized area of delamination. For example, with reference to the aperture 54 of the example carbon fiber reinforced polymer composite workpiece 50 of FIG. 4, the piercing operation may occur in a center of the aperture 54, causing a localized area of delamination, and then a spiral or other curvilinear path may be followed to approach the outer profile 56 nearly tangent thereto and then the cut may continue along a path coincident with the outer profile 56 to form the aperture 54 and to remove the localized area of delamination. In this manner, internal features with acceptable edge quality may be produced while utilizing faster piercing techniques that might otherwise compromise the integrity of the workpiece if the surrounding area was not subsequently removed.

According to some embodiments, the trimming method may further comprise maintaining a terminal end of the cutting head away from the fiber reinforced polymer composite workpiece at a distance that exceeds a threshold distance while directing the pure waterjet to pass through and pierce the fiber reinforced polymer composite workpiece, and subsequently, moving and maintaining the terminal end of the cutting head relatively closer to the fiber reinforced polymer composite workpiece while trimming the fiber reinforced polymer composite material to the final component profile. In this manner, the fiber reinforced materials may be pierced with the nozzle component of the cutting head at a first standoff distance and subsequent cutting may commence with the nozzle component at a second standoff distance that is less than the first standoff distance. Proceeding in this manner may minimize or eliminate delamination or fraying that might otherwise occur when piercing the workpiece with a pure waterjet.

According to some embodiments, the trimming method may further comprise, while moving the cutting head and the fiber reinforced polymer composite workpiece relative to each other along at least a portion of the predetermined path, simultaneously directing a gas stream onto an exposed surface of the fiber reinforced polymer composite workpiece at or adjacent (e.g., ahead of) a cutting location of the pure waterjet to maintain a cutting environment at the cutting location which is, apart from the pure waterjet, substantially devoid of fluid or particulate matter. In this manner, the path of the cut may be cleared of any standing water or particulate matter that might otherwise comprise the quality of the cut. In some instances, an air shroud may be formed around the pure waterjet in addition to or in lieu of the aforementioned gas stream.

According to some embodiments, the trimming method may further comprise introducing a gas stream into a path of the pure waterjet to alter a coherence of the pure waterjet during at least a portion of the trimming method. In this manner, coherence or other properties or characteristics of the discharged jet can be selectively altered. In some instances, for example, the jet may be altered during drilling, piercing or other procedures wherein it may be beneficial to reduce the energy of the waterjet prior to impingement on the workpiece. This can reduce delamination and other defects when cutting fiber reinforced polymer composite materials such as carbon fiber reinforced polymer composites.

According to some embodiments, moving one of the cutting head and the fiber reinforced polymer composite workpiece relative to the other along the predetermined path may include moving the cutting head with a multi-axis manipulator while the fiber reinforced polymer composite workpiece remains stationary. Alternatively, the fiber reinforced polymer composite workpiece may be moved with a multi-axis manipulator while the cutting head remains stationary.

According to embodiments of the pure waterjet trimming methods described herein, fixturing may be simplified when utilizing a pure waterjet because the pure waterjet is less destructive to support structures underlying the workpieces. Accordingly, some embodiments may include supporting the workpiece with a support structure and allowing the pure waterjet to strike or impinge upon the support structure during at least a portion of the trimming procedure. Moreover, utilizing the methods described herein and maintaining the linear power density of the discharged pure waterjet above a threshold level required to cut the fiber reinforced polymer composite workpieces may eliminate a need to support the backside of the workpiece to be processed in areas immediately adjacent the cutting locations, thereby further simplifying fixturing.

Additional features and other aspects that may augment or supplement the methods described herein will be appreciated from a detailed review of the present disclosure. Moreover, aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A method of trimming a fiber reinforced polymer composite workpiece, the method comprising:

providing the fiber reinforced polymer composite workpiece in a post-molded or post cured, untrimmed state in which fiber reinforced polymer composite material of the fiber reinforced polymer composite workpiece extends beyond a final component profile thereof; and thereafter generating a pure waterjet via a cutting head in liquid phase unladened with solid particles at an operating pressure of at least 60,000 psi;

directing the pure waterjet to pass through the fiber reinforced polymer composite material of the fiber reinforced polymer composite workpiece in the post-molded or post cured, untrimmed state; and moving at least one of the cutting head and the fiber reinforced polymer composite workpiece relative to the other at a cutting speed along a predetermined path while maintaining the operating pressure of at least 60,000 psi such that the pure waterjet trims the fiber reinforced polymer composite material of the fiber reinforced polymer composite workpiece to the final component profile wherein the cutting speed is selected to produce an edge of the fiber reinforced polymer composite workpiece with a predetermined surface roughness having at least one of an $R_a$ value of about 22 ±5 microns and an $R_z$ value of 128 ±20 microns.

2. The method of claim 1 wherein moving the cutting head and the fiber reinforced polymer composite workpiece relative to each other along the predetermined path includes moving at a cutting speed based at least in part on a thickness of the fiber reinforced polymer composite workpiece and a magnitude of the operating pressure.

3. The method of claim 2 wherein the workpiece is reinforced with carbon fibers and wherein, for at least a portion of the trimming method, the cutting speed is selected relative to the thickness of the carbon fiber reinforced polymer composite workpiece and the operating pressure to satisfy at least one of the following:

the cutting speed is between about 3,000 mm/min and about 6,000 mm/min when the operating pressure is between about 60,000 psi and about 75,000 psi and the material thickness is about 1.00 mm±0.50 mm;

the cutting speed is between about 500 mm/min and about 1,000 mm/min when the operating pressure is between about 60,000 psi and about 75,000 psi and the material thickness is about 2.50 mm±1.00 mm;

the cutting speed is between about 100 mm/min and about 250 mm/min when the operating pressure is between about 60,000 psi and about 75,000 psi and the material thickness is about 5.5 mm±2.00 mm; and the cutting speed is between about 20 mm/min and about 40 mm/min when the operating pressure is between about 60,000 psi and about 75,000 psi and the material thickness is about 10.0 mm±2.50 mm.

4. The method of claim 2 wherein the workpiece is reinforced with carbon fibers and wherein, for at least a portion of the trimming method, the cutting speed is selected relative to the thickness of the carbon fiber reinforced polymer composite workpiece and the operating pressure to satisfy at least one of the following:

the cutting speed is between about 8,000 mm/min and about 12,000 mm/min when the operating pressure is between about 75,000 psi and about 90,000 psi and the material thickness is about 1.00 mm±0.50 mm;

the cutting speed is between about 1,200 mm/min and about 2,000 mm/min when the operating pressure is between about 75,000 psi and about 90,000 psi and the material thickness is about 2.50 mm±1.00 mm;

the cutting speed is between about 300 mm/min and about 500 mm/min when the operating pressure is between about 75,000 psi and about 90,000 psi and the material thickness is about 5.5 mm±2.00 mm; and the cutting speed is between about 75 mm/min and about 120 mm/min when the operating pressure is between about 75,000 psi and about 90,000 psi and the material thickness is about 10.0 mm±2.50 mm.

5. The method of claim 2 wherein the cutting speed is also based at least in part on a type of fiber, a type of matrix material, and/or a type of fabrication scheme of the fiber reinforced polymer composite workpiece.

6. The method of claim 5 wherein the fiber reinforced polymer composite workpiece includes carbon fibers, glass fibers, boron fibers or polyamide fibers, and wherein the fiber reinforced polymer composite workpiece is built up from layers of fibers, tape or cloth impregnated with the matrix material.

7. The method of claim 2 wherein the cutting speed is also based at least in part on an orifice size of an orifice member used to generate the pure waterjet, the cutting speed increasing with increases in the orifice size for orifice sizes in a range of about 0.005 inch to about 0.010 inch.

8. The method of claim 1 wherein generating the pure waterjet via the cutting head in liquid phase unladened with solid particles includes generating the pure waterjet via an orifice member having a diameter less than about 0.010 inch.

9. The method of claim 1 wherein generating the pure waterjet via the cutting head in liquid phase unladened with solid particles includes generating the pure waterjet via an orifice member having a diameter of about 0.005 inch.

10. The method of claim 1, further comprising:

piercing the fiber reinforced polymer composite workpiece in the post-molded or post cured, untrimmed state at an area within the final component profile at any operating pressure and creating an aperture surrounded by a localized area of delamination; and moving one of the cutting head and the fiber reinforced polymer composite workpiece relative to the other along another predetermined path while maintaining operating pressure of at least 60,000 psi such that the pure waterjet cuts an internal feature within the fiber reinforced polymer composite material and removes the localized area of delamination.

11. The method of claim 1, further comprising:

while moving the cutting head and the fiber reinforced polymer composite workpiece relative to each other along at least a portion of the predetermined path, simultaneously directing a gas stream onto an exposed surface of the fiber reinforced polymer composite workpiece at or adjacent a cutting location of the pure waterjet to maintain a cutting environment at the cutting location which is, apart from the pure waterjet, substantially devoid of fluid or particulate matter.

12. The method of claim 1, further comprising:

maintaining a terminal end of the cutting head away from the fiber reinforced polymer composite workpiece at a first distance that exceeds a second distance while directing the pure waterjet to pass through and pierce the fiber reinforced polymer composite workpiece, and subsequently, moving and maintaining the terminal end of the cutting head at a third distance that is less than or equal to the second distance while trimming the fiber reinforced polymer composite material to the final component profile.

13. The method of claim 1, further comprising:

introducing a gas stream into a path of the pure waterjet to alter a coherence of the pure waterjet during at least a portion of the trimming method, such as when piercing or trimming the fiber reinforced polymer composite workpiece.

14. The method of claim 1 wherein moving one of the cutting head and the fiber reinforced polymer composite workpiece relative to the other along the predetermined path includes moving the cutting head with a multi-axis manipulator while the fiber reinforced polymer composite workpiece remains stationary.

15. The method of claim 1 wherein moving one of the cutting head and the fiber reinforced polymer composite workpiece relative to the other along the predetermined path includes moving the fiber reinforced polymer composite workpiece with a multi-axis manipulator while the cutting head remains stationary.

16. The method of claim 1, further comprising:

controlling a cutting speed based on a plurality of operating parameters including material thickness, material type, operating pressure and orifice size.

17. The method of claim 16 wherein the plurality of operating parameters further include a tolerance level.

18. The method of claim 1 wherein the workpiece is reinforced with carbon fibers and wherein the carbon fiber reinforced polymer composite workpiece is an automotive component.

19. The method of claim 1 wherein moving at least one of the cutting head and the fiber reinforced polymer composite workpiece relative to the other includes producing an edge of the fiber reinforced polymer composite workpiece with less than 10% backside linear defects.

20. The method of claim 1, further comprising:

engaging one or more indexing features defined by the fiber reinforced polymer composite workpiece, thereby aligning the fiber reinforced polymer composite workpiece relative to the cutting head.

21. The method of claim 20, wherein the one or more indexing features are located outside the final component profile.

22. The method of claim 10 wherein the predetermined path is curvilinear and approaches the outer profile of the aperture approximately tangent thereto.

23. The method of claim 1, further comprising:

generating an air shroud around the pure waterjet.

24. A method of trimming a fiber reinforced polymer composite workpiece, the method comprising:

providing the fiber reinforced polymer composite workpiece in a post-molded or post cured, untrimmed state in which fiber reinforced polymer composite material of the fiber reinforced polymer composite workpiece extends beyond a final component profile thereof, the fiber reinforced polymer composite workpiece having a thin shell structure; and thereafter generating a pure waterjet via a cutting head in liquid phase unladened with solid particles at an operating pressure of at least 60,000 psi, the cutting head supported by a multi-axis manipulator; and moving the cutting head via the multi-axis manipulator relative to the fiber reinforced polymer composite workpiece along a predetermined path while directing the pure waterjet to pass through the fiber reinforced polymer composite material of the fiber reinforced polymer composite workpiece, maintaining the operating pressure of at least 60,000 psi, and controlling a cutting speed based on a plurality of operating parameters including material thickness, material type, operating pressure, standoff distance and orifice size, such that the pure waterjet trims the fiber reinforced polymer composite material of the fiber reinforced polymer composite workpiece to the final component profile thereby defining an edge of the fiber reinforced polymer composite workpiece with a surface roughness having at least one of an $R_a$ value of about 22 ±5 microns and an $R_z$ value of 128 ±20 microns.

* * * * *